US009523269B2

(12) United States Patent
Hoult et al.

(10) Patent No.: US 9,523,269 B2
(45) Date of Patent: Dec. 20, 2016

(54) AUTOMATIC CONTROL SYSTEM AND METHOD FOR A DRILLING TOOL CHANGER APPARATUS

(71) Applicant: Caterpillar Global Mining Equipment LLC, South Milwaukee, WI (US)

(72) Inventors: Ross L. Hoult, Eight Mile Plains (AU); Samuel C. Taylor, Bungendore (AU); Andrew Wright, Newcastle (AU); Timo Diekmann, Castrop-Rauxel (DE); Chinpei Tang, McKinney, TX (US); Marcus U. Bähtz, Duisburg (DE); Vin J. Varghese, McKinney, TX (US)

(73) Assignee: Caterpillar Global Mining Equipment LLC, Denison, TX (US)

( * ) Notice: Subject to any disclaimer, the term of this patent is extended or adjusted under 35 U.S.C. 154(b) by 693 days.

(21) Appl. No.: 13/964,492

(22) Filed: Aug. 12, 2013

(65) Prior Publication Data

US 2014/0083765 A1 Mar. 27, 2014

Related U.S. Application Data

(60) Provisional application No. 61/704,327, filed on Sep. 21, 2012.

(51) Int. Cl.
*E21B 44/00* (2006.01)

(52) U.S. Cl.
CPC ..... *E21B 44/00* (2013.01)

(58) Field of Classification Search
CPC ..... E21B 44/00; E21B 19/165; E21B 19/15; E21B 19/16; E21B 19/20; E21B 19/146; E21B 1/02; E21B 3/02
See application file for complete search history.

(56) References Cited

U.S. PATENT DOCUMENTS

| | | | | |
|---|---|---|---|---|
| 3,300,856 | A * | 1/1967 | Daugherty | B23Q 3/1552 483/40 |
| 3,977,480 | A | 8/1976 | Hilding | |
| 4,042,123 | A * | 8/1977 | Sheldon | E21B 19/20 175/85 |
| 6,338,003 | B1 * | 1/2002 | Kamiguchi | G05B 19/409 700/169 |
| 6,985,750 | B1 * | 1/2006 | Vicknair | H04W 8/20 370/310 |
| 7,886,846 | B2 | 2/2011 | Pires | |

(Continued)

FOREIGN PATENT DOCUMENTS

GB 2397833 A * 8/2004 ..... E21B 23/00

*Primary Examiner* — David Andrews
*Assistant Examiner* — Ronald Runyan
(74) *Attorney, Agent, or Firm* — Foley & Lardner LLC

(57) ABSTRACT

A control system for an automatic drilling tool changer apparatus for use with a drilling rig includes a drilling control device programmed with a control scheme for controlling the automatic drilling tool changer apparatus, and a user interface coupled to the drilling control device for initiating actions of the automatic drilling tool changer apparatus and for interactively monitoring a status of the automatic drilling tool changer apparatus. The control scheme includes steps for an automatic drilling tool change-out operation, and the drilling control device and the user interface are configured to communicate with the automatic drilling tool changer apparatus over a network.

11 Claims, 29 Drawing Sheets

(56) References Cited

U.S. PATENT DOCUMENTS

| | | | | |
|---|---|---|---|---|
| 2004/0012620 | A1* | 1/2004 | Buhler | G09F 27/00 715/716 |
| 2006/0066626 | A1* | 3/2006 | Kainuma | G05B 19/056 345/564 |
| 2006/0162963 | A1 | 7/2006 | Hagemeyer et al. | |
| 2008/0244707 | A1* | 10/2008 | Bowser | H04L 63/1441 726/4 |

* cited by examiner

180

190

AUTOMATIC CONTROL SYSTEM AND METHOD FOR A DRILLING TOOL CHANGER APPARATUS

CROSS-REFERENCE TO RELATED APPLICATIONS

This application claims the benefit of priority to U.S. Provisional Patent Application No. 61/704,327, which was filed on Sep. 21, 2012, the complete disclosure of which is incorporated by reference herein.

TECHNICAL FIELD

This disclosure relates to drilling systems and a drilling tool changer apparatus, and more particularly to a control system for operating an automatic drilling tool changer apparatus for use in applications such as mining and other down-hole drilling applications (e.g. petroleum, natural gas, wells, etc.).

BACKGROUND

This section is intended to provide a background or context to the invention recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

Drilling systems are generally known to include a vertical drill tower (e.g. mast, etc.) constructed from structural members such as steel beams and reinforcing supports. The drill tower is often coupled to a mobile platform (e.g. having an operator's cab or the like, which along with other components typically form a drilling rig) for positioning the drill tower in a desired location to conduct a drilling operation. The drill tower is often equipped with a drill carousel which is structured and adapted to support a drill string formed from a combination of drill extenders (e.g. drill rods, drill pipes, etc.) for selectively adding the drill extenders to the drill string for drilling a hole having a desired depth. The drill carousel is intended to allow a drilling operation to progress into the drill hole by making readily available a continuous string of drill extenders as needed for advancing a drilling tool into a drill hole.

The initial (e.g. the first and therefore lowermost) drill extender in the drill string is configured to receive a drilling tool at its lower end to conduct the drilling operation. The drilling tool is usually a drill bit (such as a tricone drill bit) or a hammering tool (e.g. for fracturing substrate such as rock formations, etc.). After a certain amount of usage in the drilling operation it is often desirable to change (e.g. remove, replace, change-out, etc.) the drilling tool due to (for example) accumulated wear of an in-service drill bit, the need to change between a drill bit and a hammering tool (or vice versa), etc. In order to minimize downtime in the drilling operation due to change-out of drilling tools, mechanisms may be provided to facilitate removing one drilling tool from the end of the drilling string and replacing it with another drilling tool from a storage or supply location.

One example of such a mechanism is shown in U.S. Pat. No. 3,977,480 which generally shows a magazine for storing drill bits and a swingable arm to facilitate transfer of the drill bits between the magazine and the drill string. Another example of such a mechanism is shown in U.S. Patent Application Publication No. 2006/0162963 which generally shows a magazine for storing drill bits and a swingable arm having a rotatable carousel on one end to facilitate transfer of the drill bits between the magazine and the drill string. Another example is U.S. Pat. No. 7,886,846 which discloses a rotary carousel device. However, the disclosed mechanisms generally require a relatively large number of personnel and manual operation of the components to accomplish the replacement of drilling tools on a drill string.

SUMMARY

An embodiment of the present disclosure relates to a control system for an automatic drilling tool changer apparatus for use with a drilling rig. The control system includes a drilling control device programmed with a control scheme for controlling the automatic drilling tool changer apparatus, and a user interface coupled to the drilling control device for initiating actions of the automatic drilling tool changer apparatus and for interactively monitoring a status of the automatic drilling tool changer apparatus. In this embodiment, the control scheme includes steps for an automatic drilling tool change-out operation, and the drilling control device and the user interface are configured to communicate with the automatic drilling tool changer apparatus over a network.

Another embodiment of the present disclosure relates to a system for automatically changing a drilling tool for a drilling rig. The system includes a drilling tool changer apparatus. The drilling tool changer apparatus includes a pivotally movable drill tower supporting a drill pipe, and a pivotable drilling tool storage device including a laterally translatable carriage and a storage cassette having a storage receptacle for storing the drilling tool. In this embodiment, the drilling tool storage device moves to position the drilling tool in coaxial alignment with the drill pipe. The system also includes a drilling control device programmed with a control scheme for controlling the drilling tool changer apparatus, and a user interface coupled to the drilling control device for initiating actions of the drilling tool changer apparatus and for interactively monitoring a status of the drilling tool changer apparatus. In this embodiment, the control scheme includes steps for an automatic drilling tool change-out operation, and the drilling control device and the user interface are configured to communicate with the drilling tool changer apparatus over a network.

Another embodiment of the present disclosure relates to a method for controlling a drilling tool changer apparatus to automatically change out a drilling tool. The method includes providing a drilling control device having a user interface, wirelessly coupling the drilling control device to the drilling tool changer apparatus by a network, and programming a control scheme including an automatic drilling tool change-out operation to the drilling control device.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Figure 1:
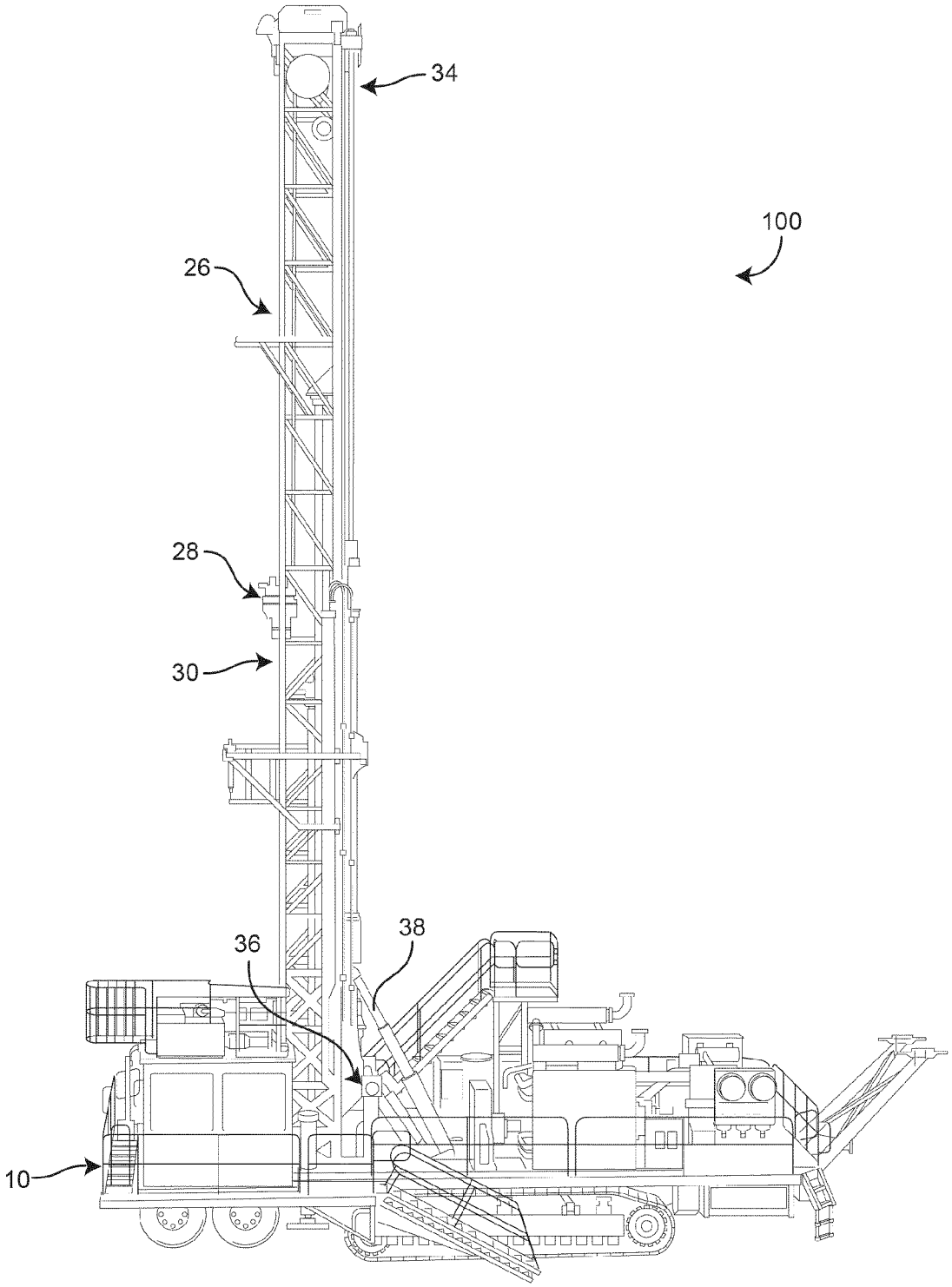
FIG. 1 is a schematic image of a drilling rig, according to an exemplary embodiment of the present disclosure.
Figure 2:
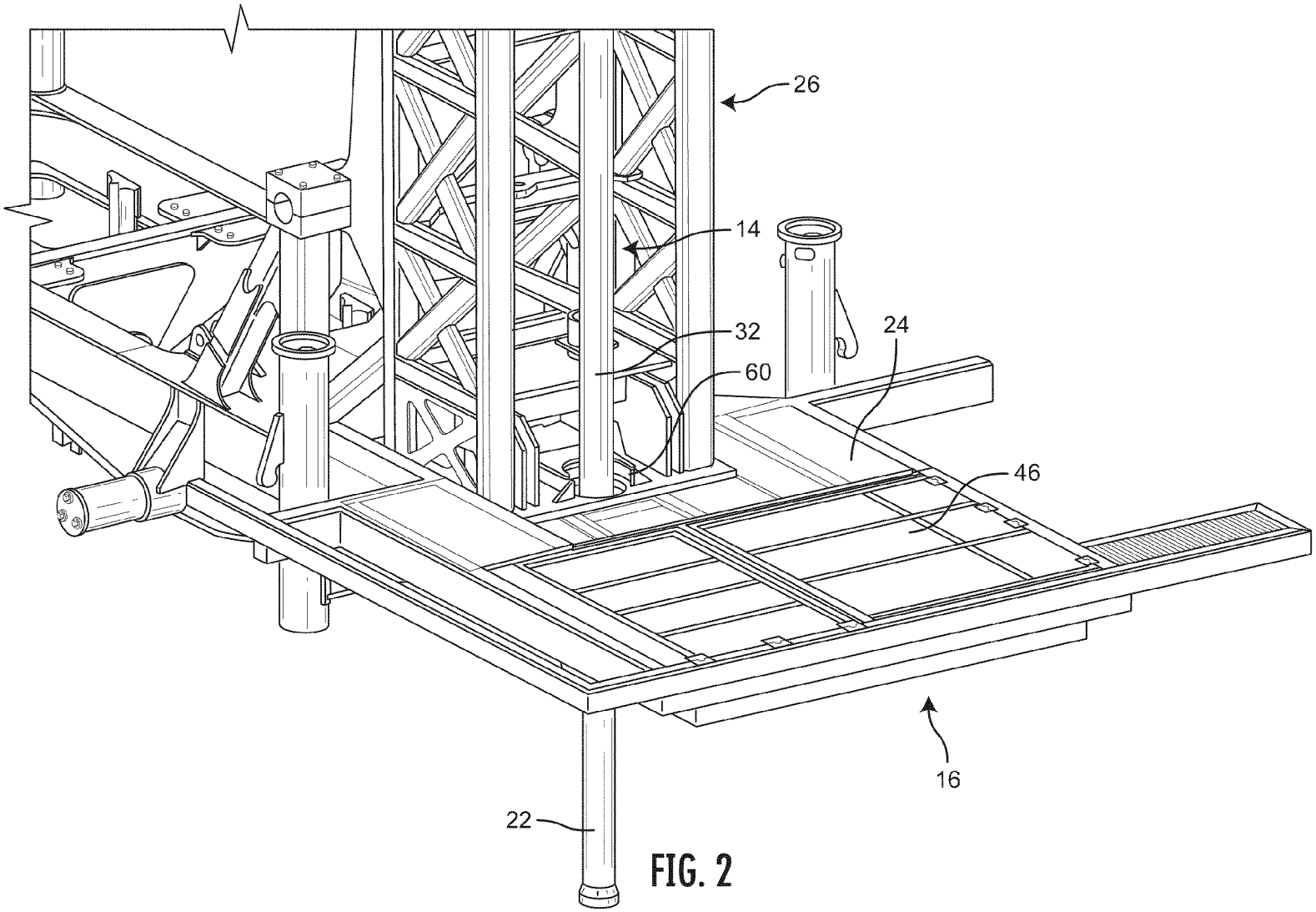
FIGS. 2-15 are schematic images of an apparatus for changing drilling tools on a drill string, according to an exemplary embodiment.
Figure 3:
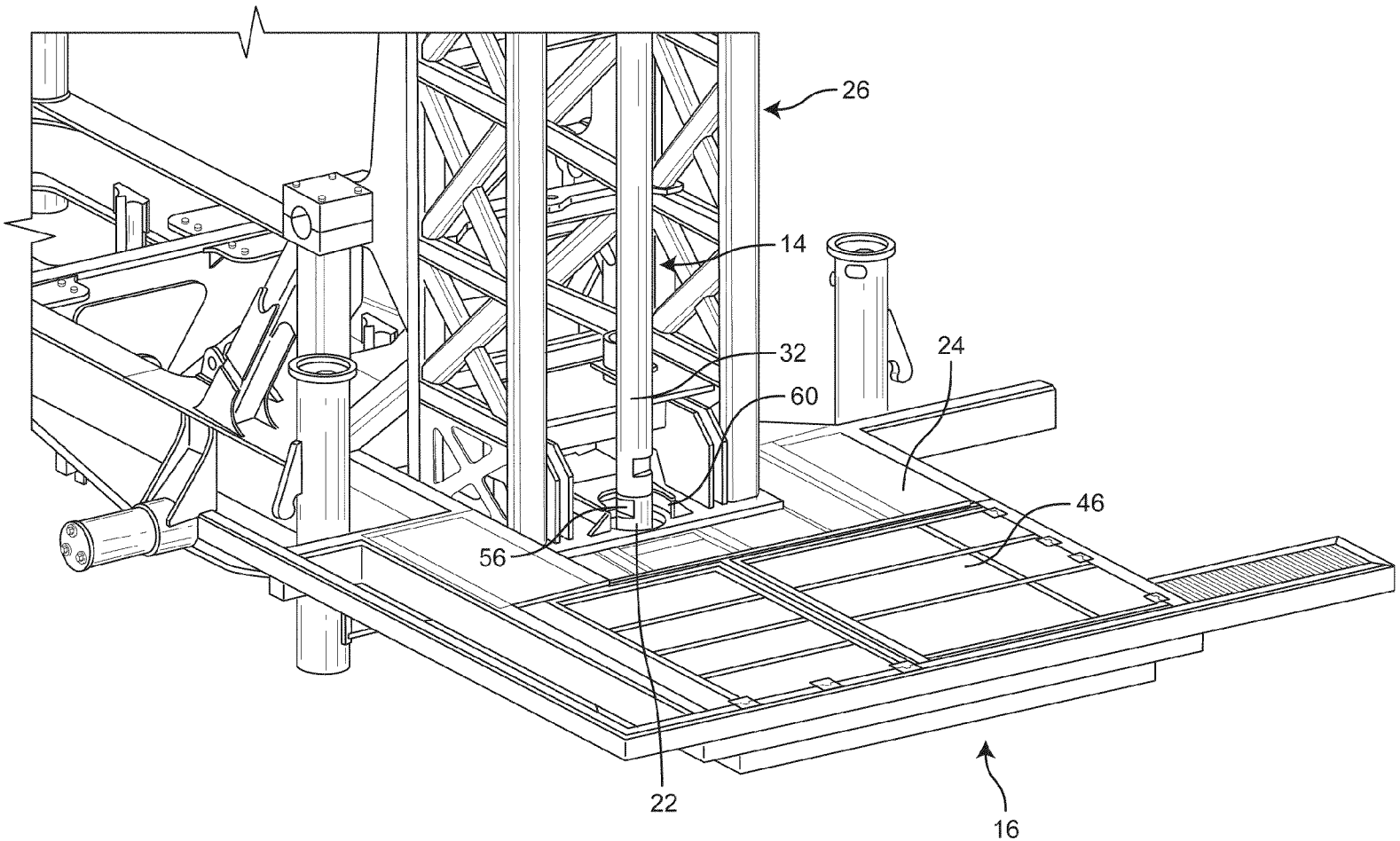
Figure 4:
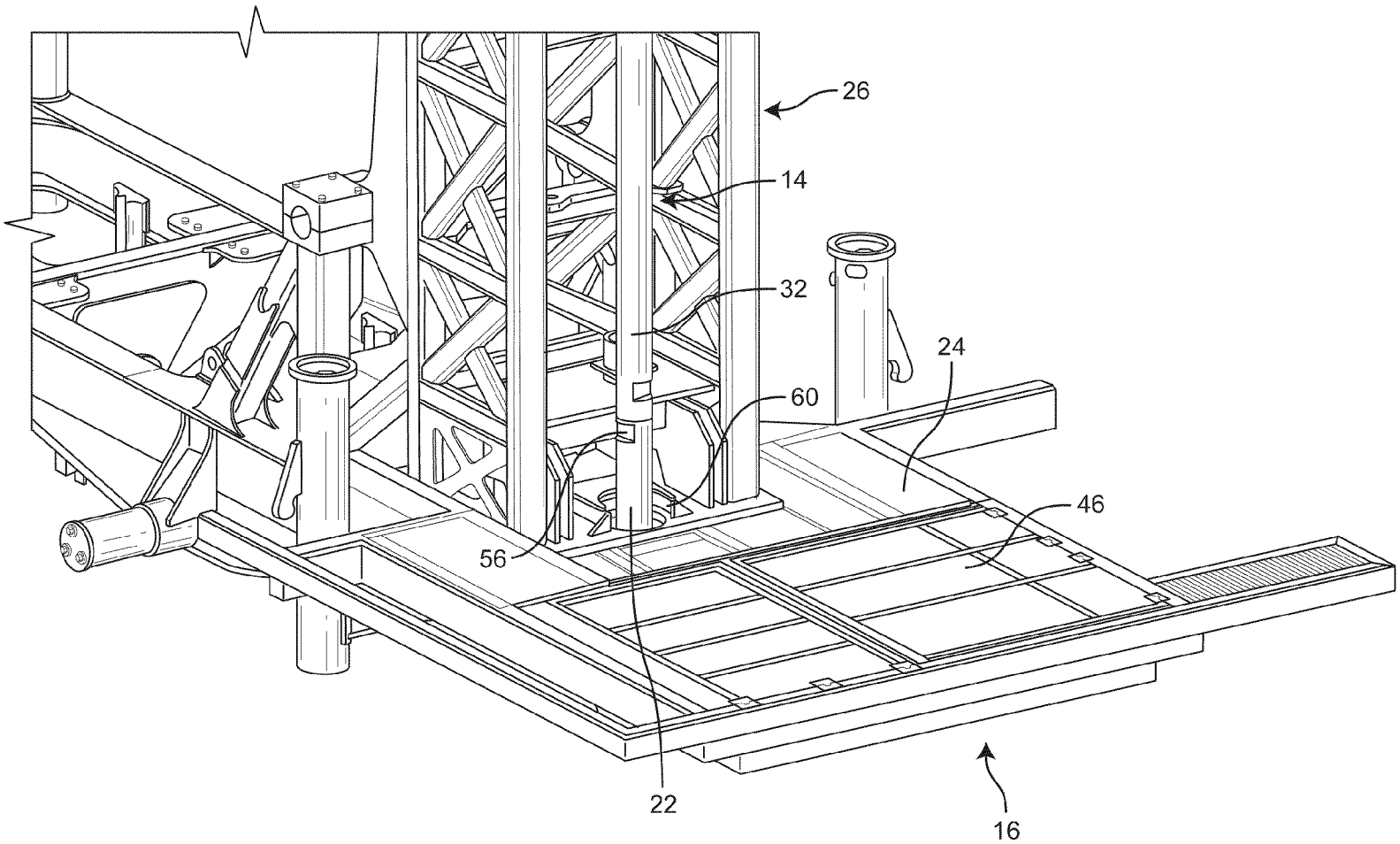
Figure 5:
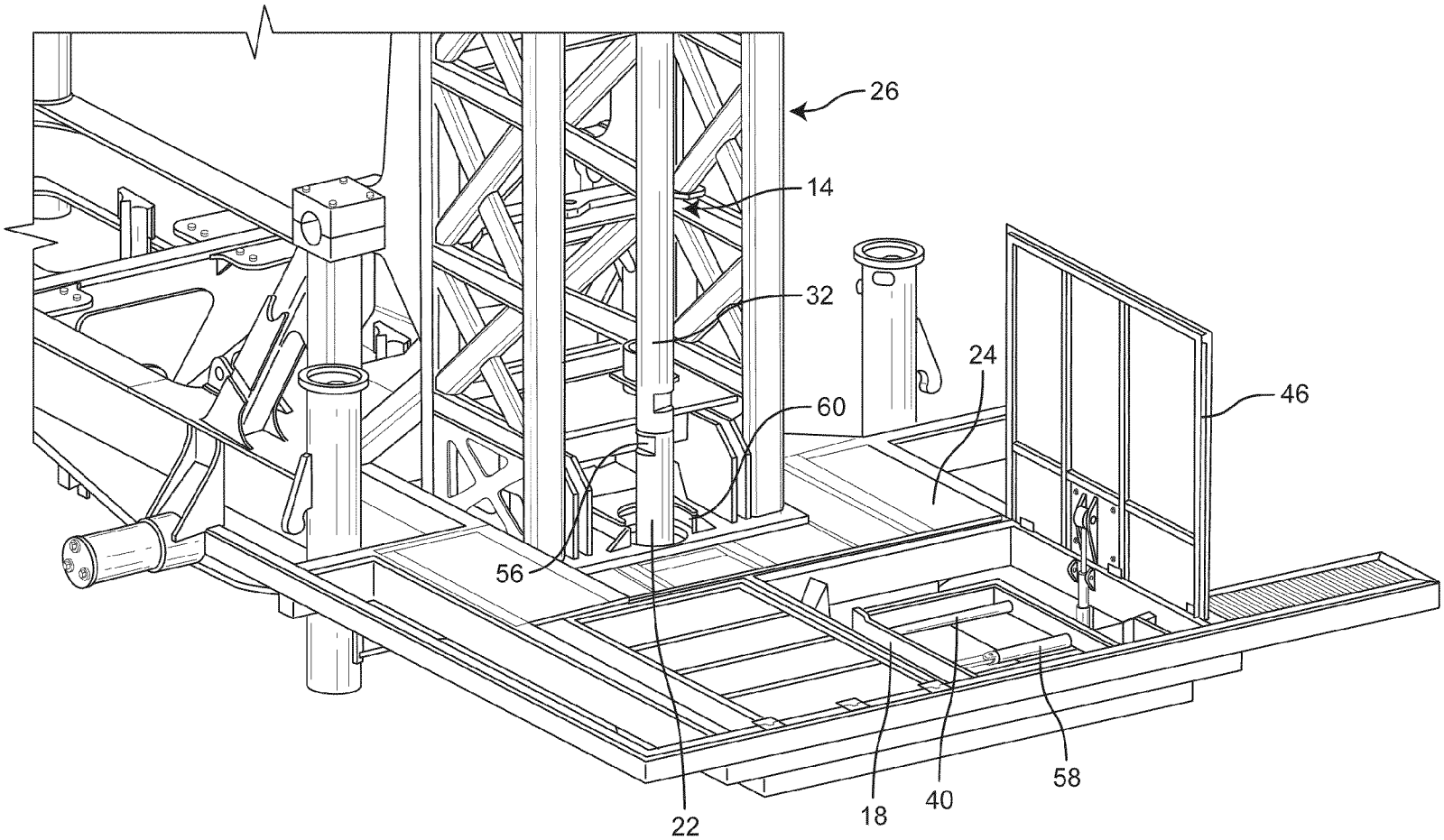
Figure 6:
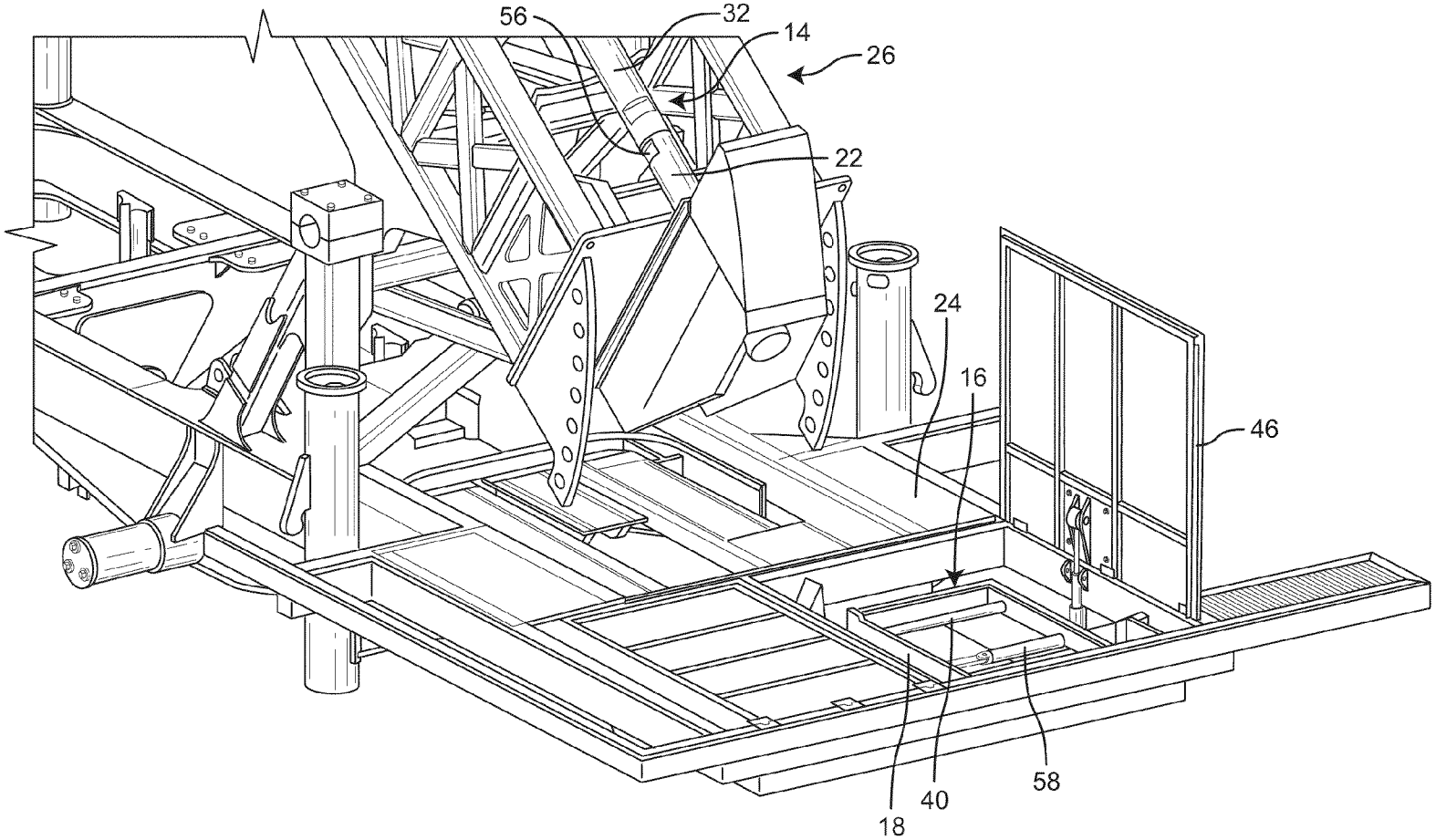
Figure 7:
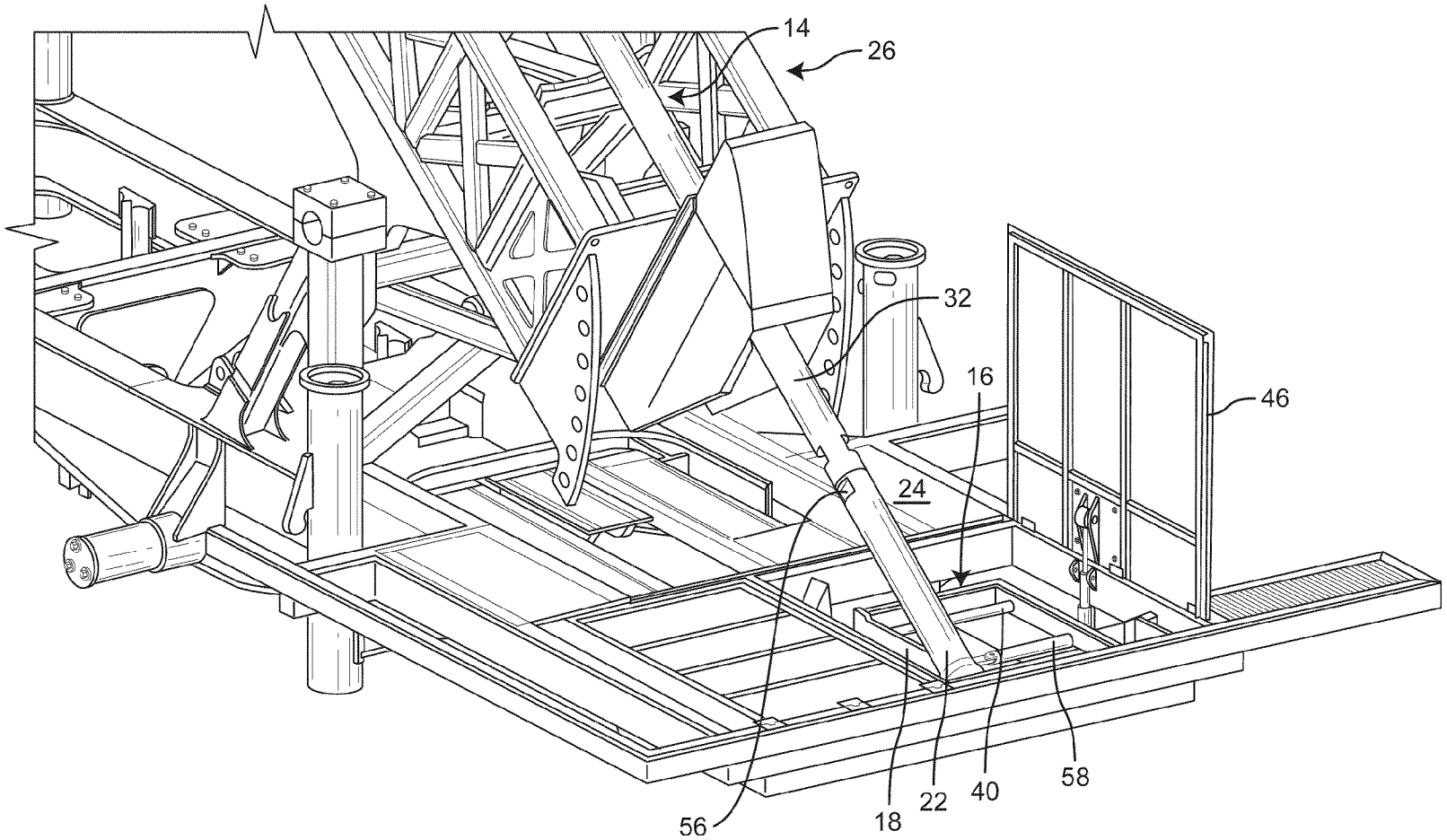
Figure 8:
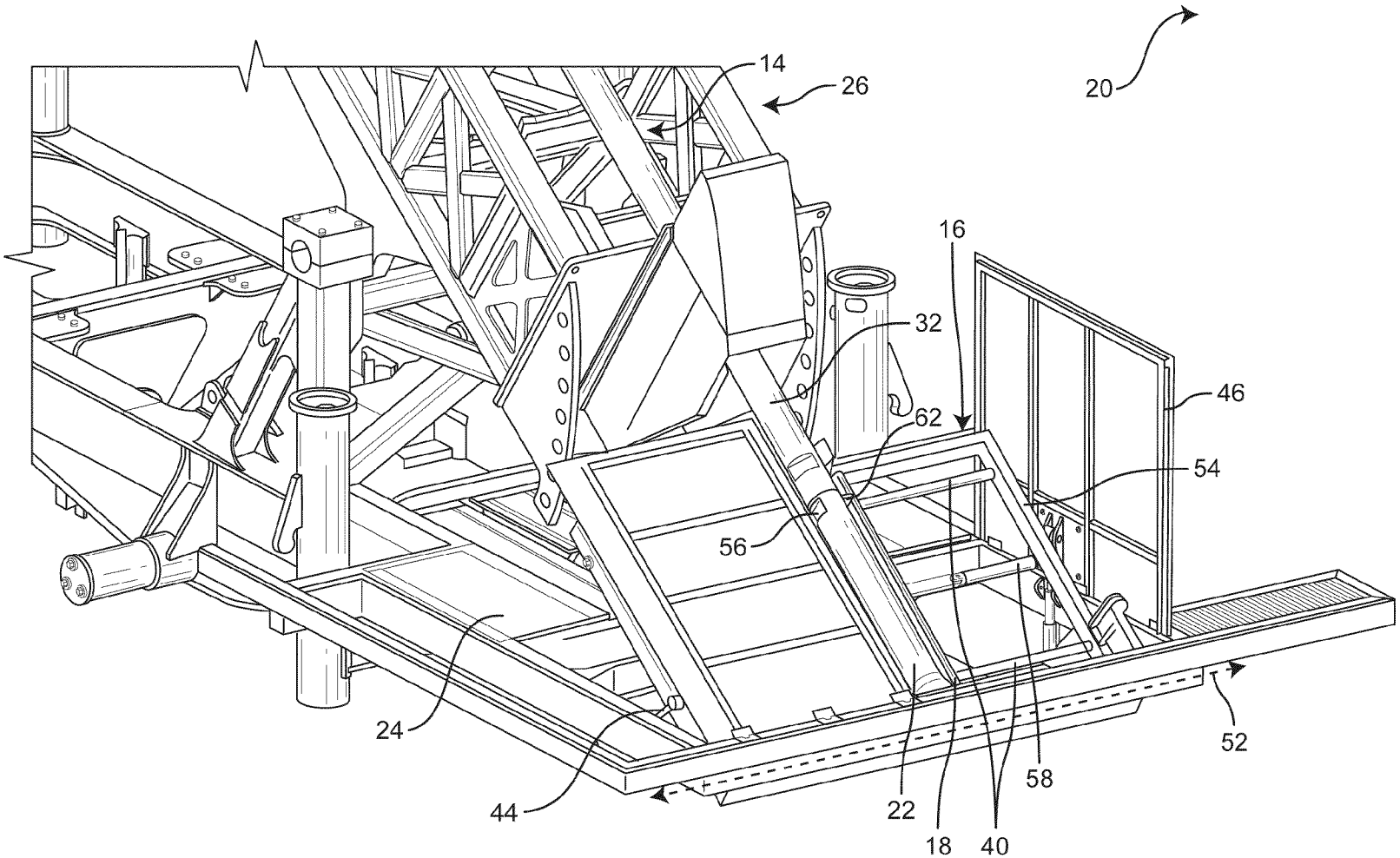
Figure 9:
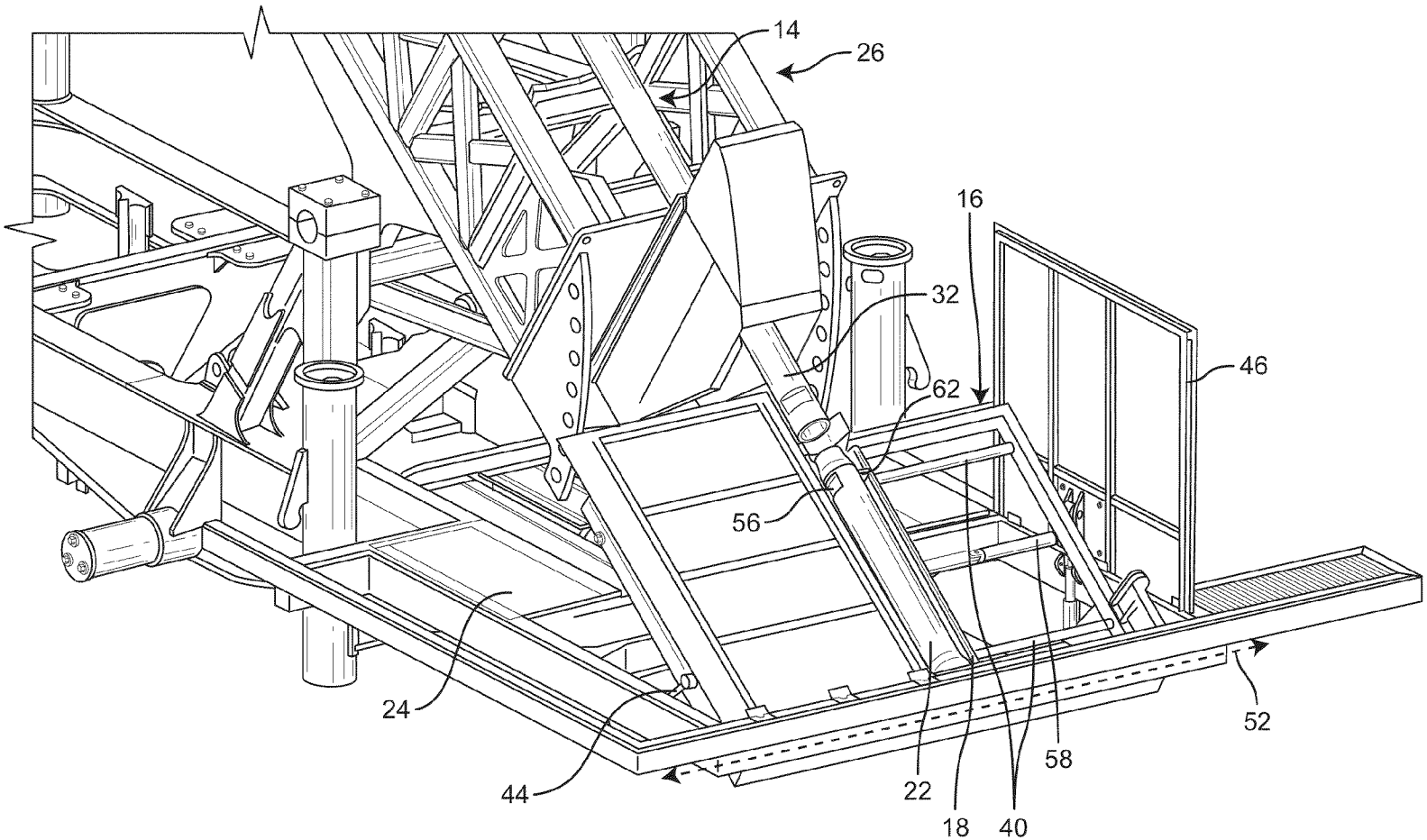
Figure 10:
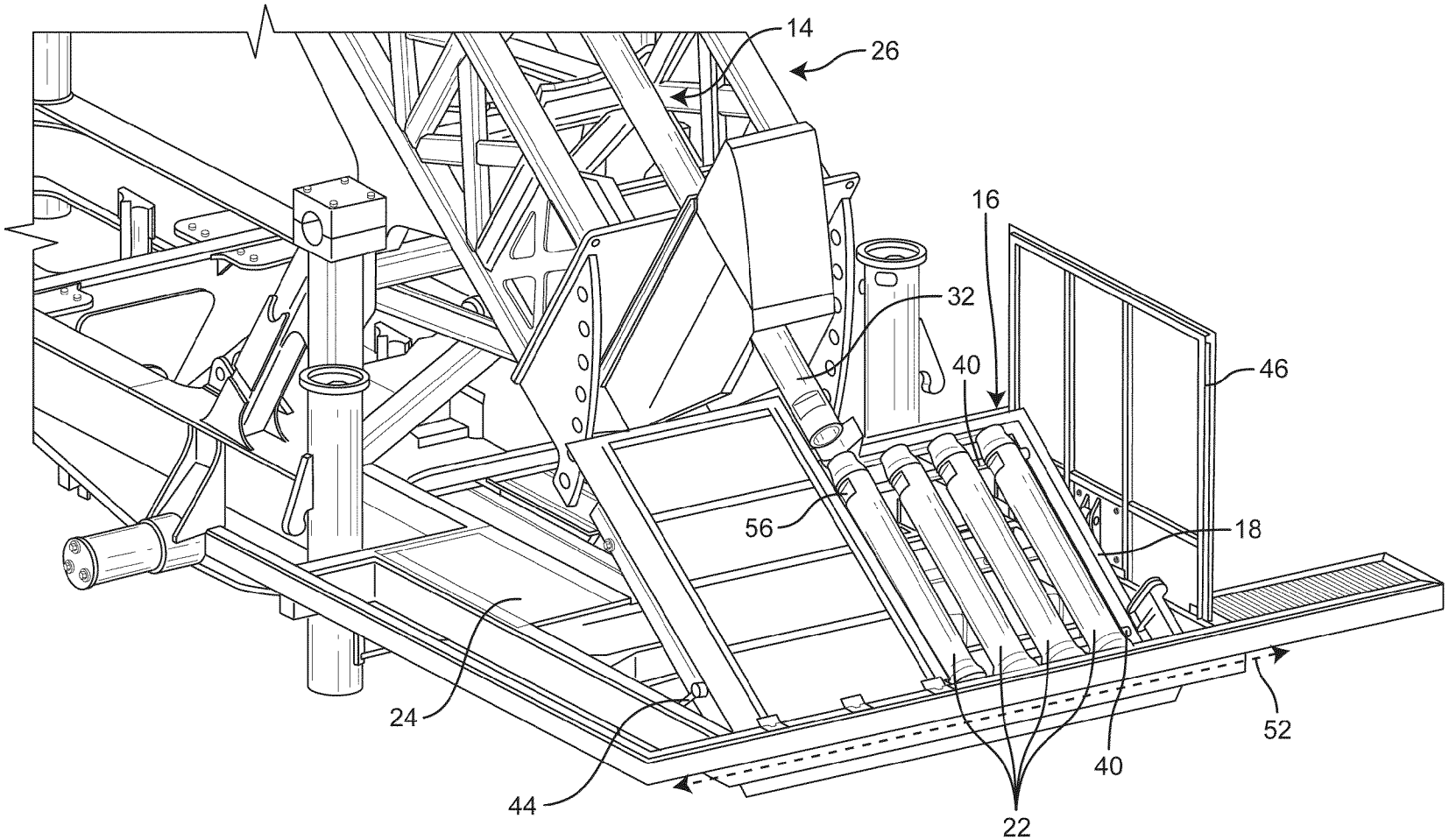
Figure 11:
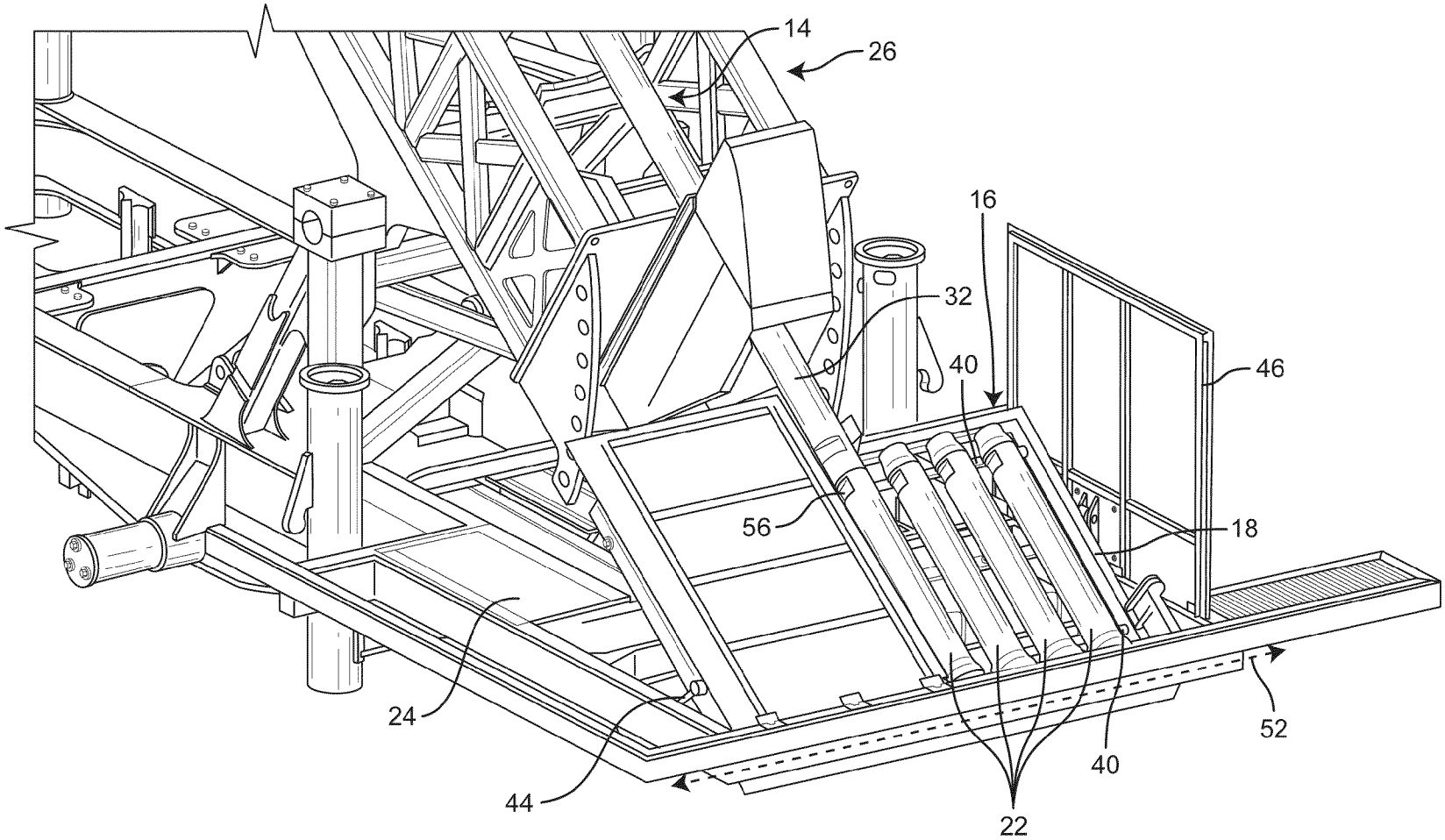
Figure 12:
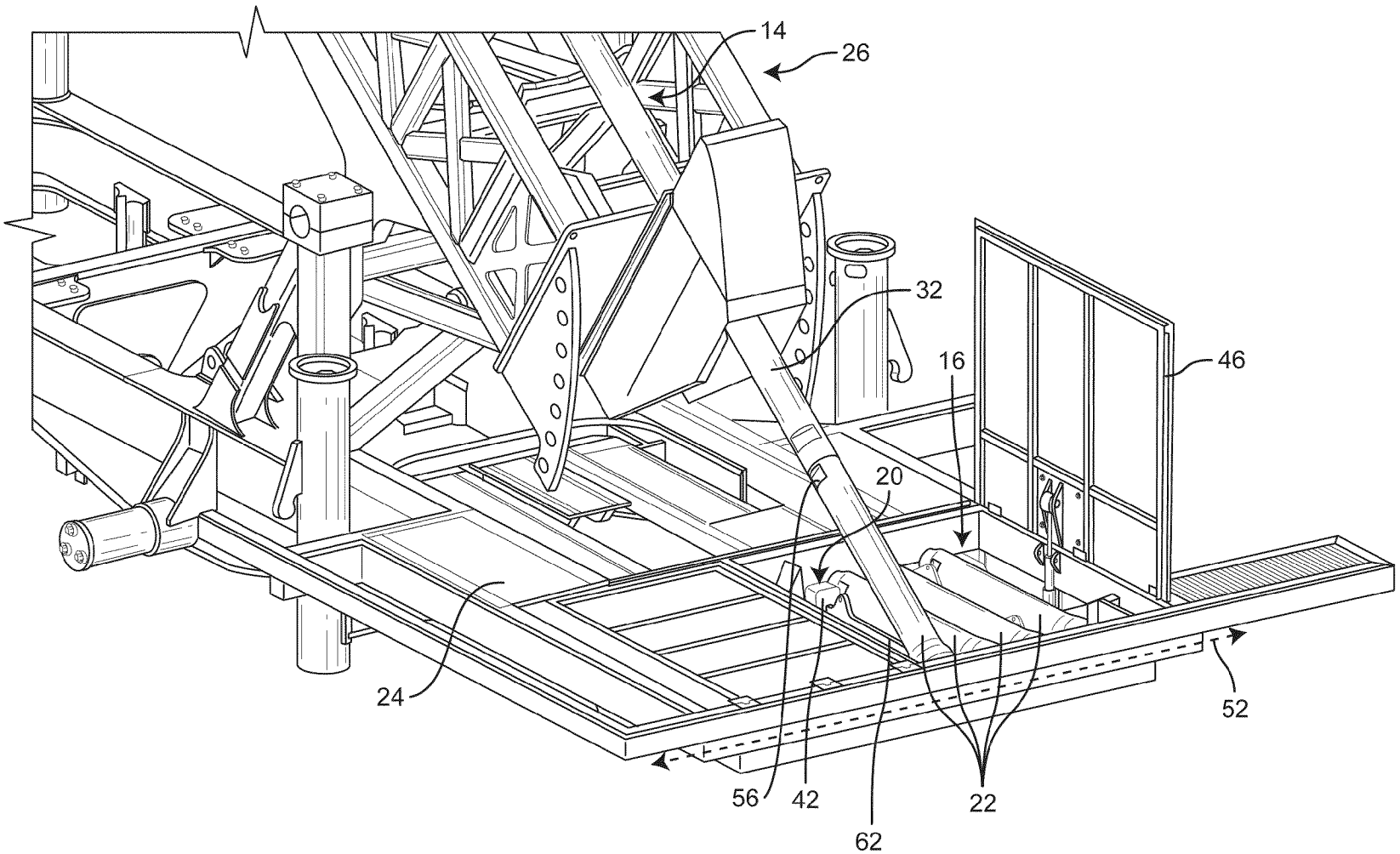
Figure 13:
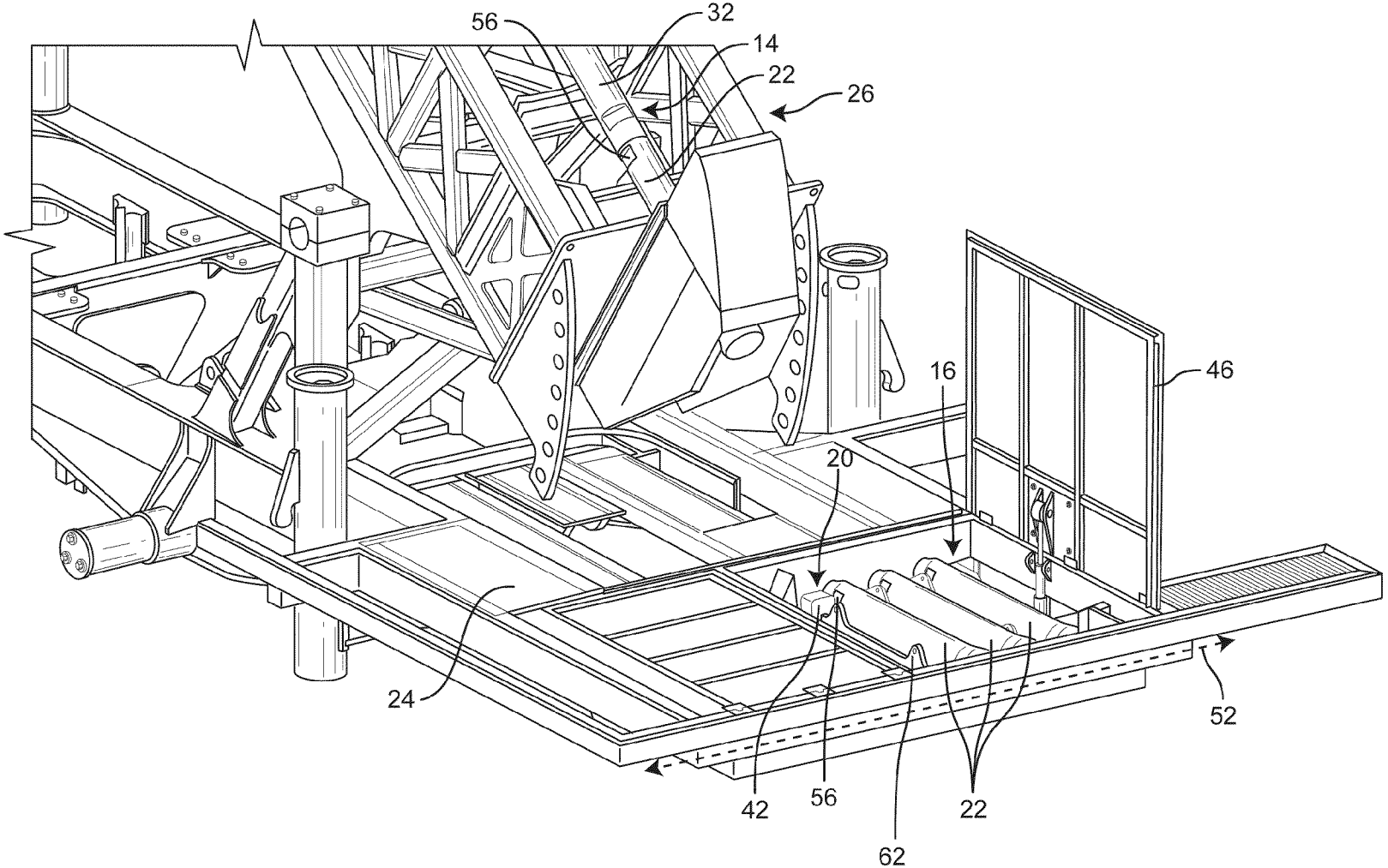
Figure 14:
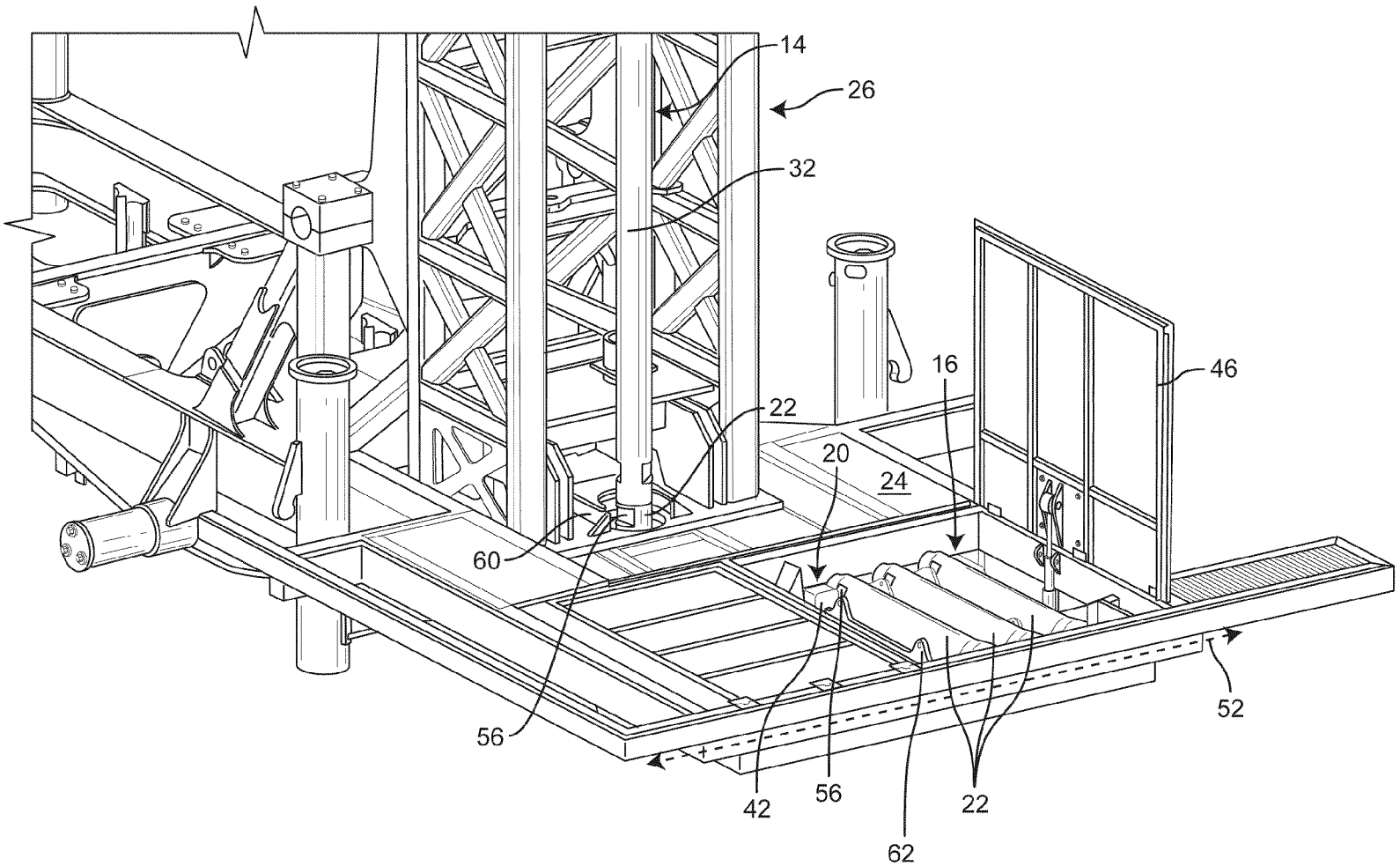
Figure 15:
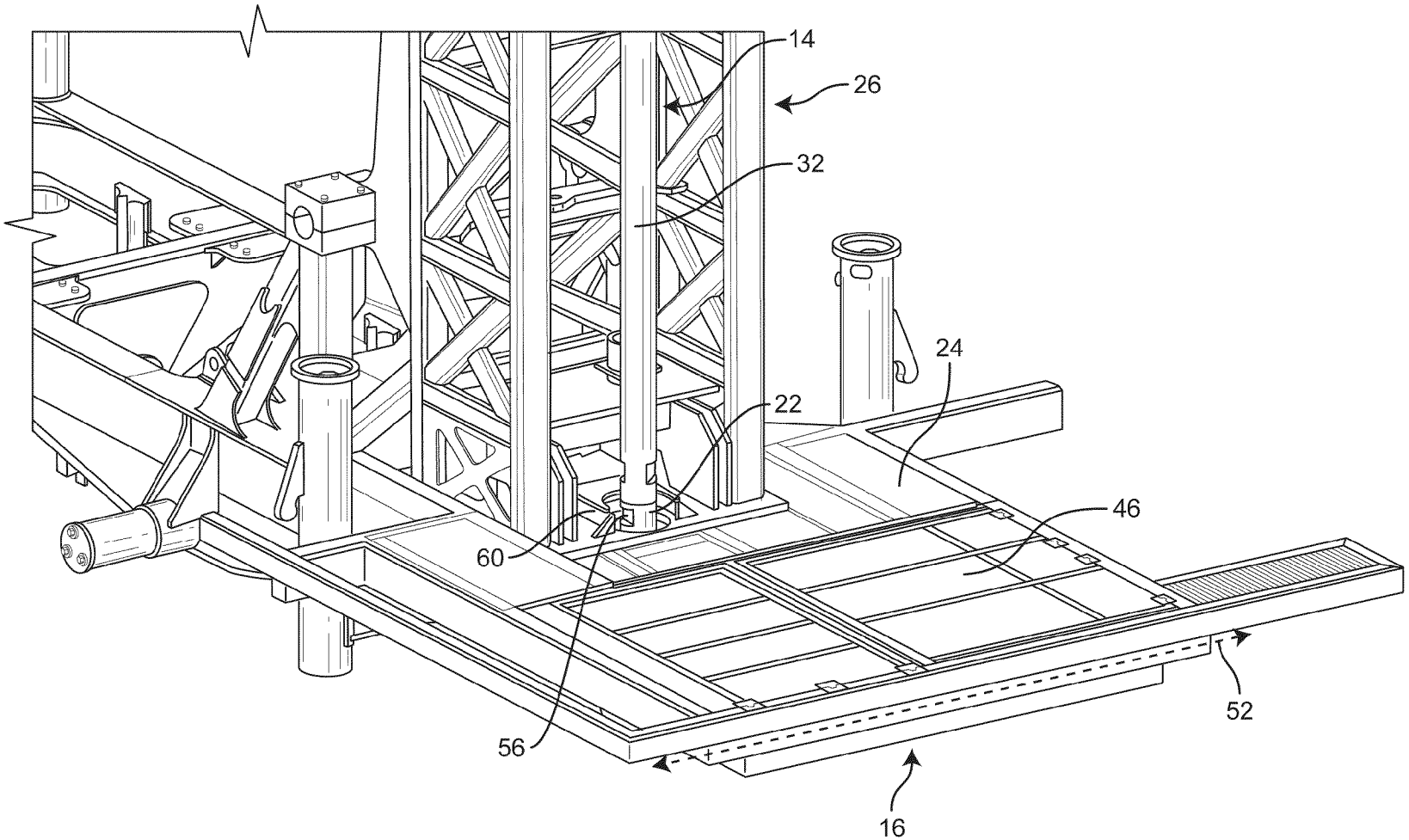
Figure 16:
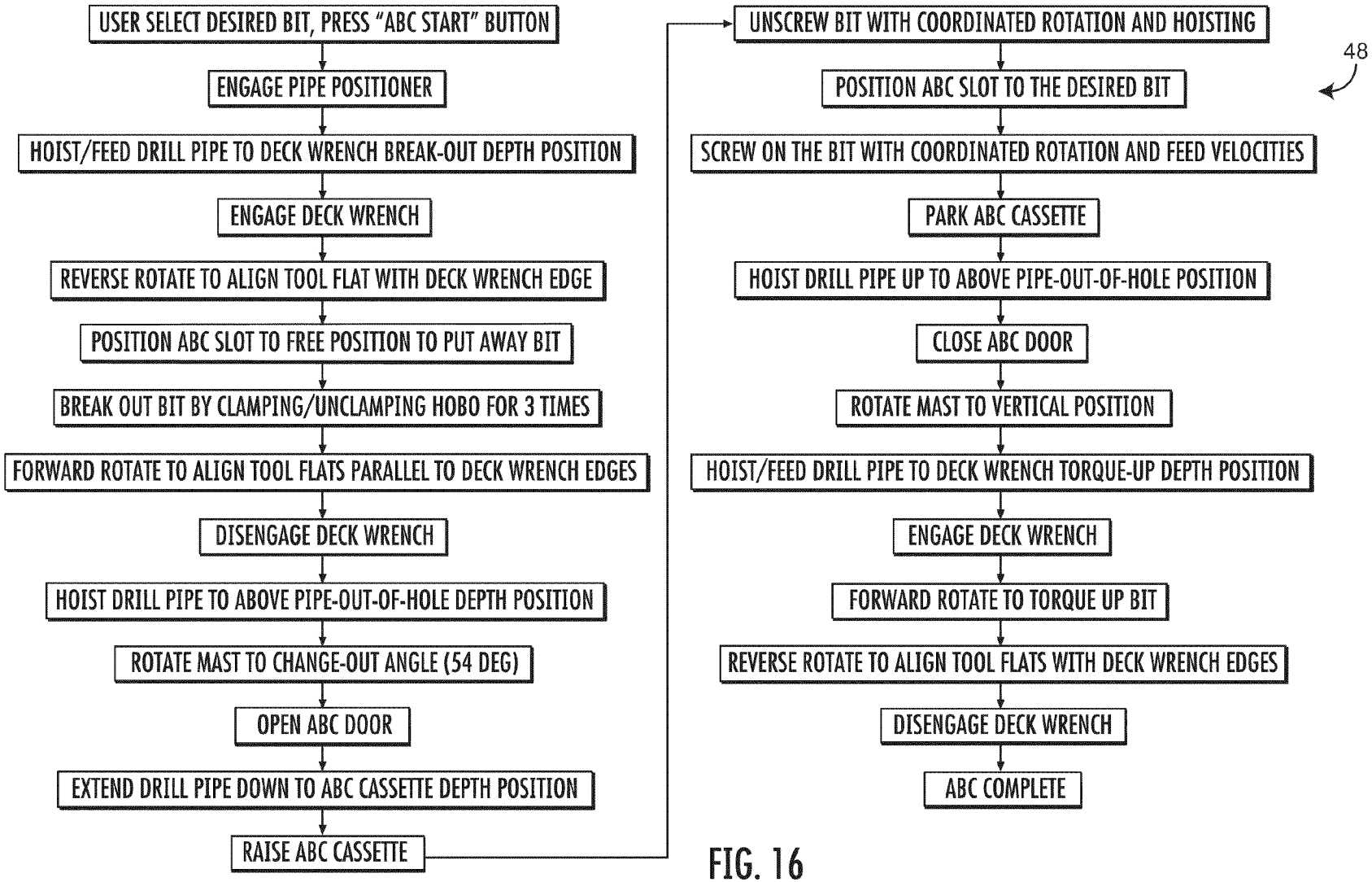
FIG. 16 is a flow chart of a control scheme or algorithm for operating an automatic drilling tool changer apparatus of a type shown in FIGS. 2-15, according to an exemplary embodiment.

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Referring to the Figures, a control system and method for operating an automatic drill changer apparatus 10 for use with a drilling rig 100 (or other suitable mobile or stationary drilling system) are shown according to an exemplary embodiment for use in mining, excavation, wells, blast hole drilling or other drilling or boring operations. Although the control system and method for operating a drilling tool changer apparatus 10 are shown and described by way of example as being used with a remotely operated and controlled mobile drilling rig 100, the drill changer apparatus 10 of the present disclosure is suitable for use with any of a wide variety of other mobile or stationary drilling systems, which may be locally operated and controlled by a local operator cab or the like. All such variations are intended to be within the scope of this disclosure.

Referring to the Figures, a drilling rig 100 having an automatic drilling tool changer apparatus 10 for use with a rotary drilling machine such as the drilling rig 100 is shown according to an exemplary embodiment. The drilling tool changer apparatus 10 to be further described herein is intended to facilitate the automatic (or semi-automatic) change-out of drilling tools 22 (shown in FIGS. 2-15) in response to remotely controlled and/or automated instructions received from a drilling control device 12 shown in FIG. 20 to be a computer device (e.g. tablet or notebook computer, etc.) programmed to implement a control scheme (e.g., control scheme 48) for operating the apparatus 10 and having a user interface, such as a touch screen or the like for inputting data, instructions and the like, and that wirelessly communicates with the apparatus 10 over a network 50 (shown in FIG. 20), receives feedback data (e.g. equipment status, drilling tool locations, exceptions, alarms, etc.) from the apparatus 10, permits monitoring of the actions/status of the apparatus 10, etc. The drilling control device 12 also monitors and keeps track of other parameters, such as drilling tool loading position, drilling tool history, and details of the drilling tools 22 (e.g. serial numbers, footage, wear, etc.). The drilling control device 12 is also programmed with sufficient interlocks and equipment status checks to prevent operation of certain functions that may cause conflict or interference among the components of the apparatus 10 or a drill string 14 (shown in FIGS. 2-15). According to one embodiment, the drilling control device 12 is intended to permit initiation of an automatic drilling tool change-out operation (i.e., the change-out operation) by the apparatus 10 based upon a single instruction (e.g. 'touch of a button').

The drilling tool changer apparatus 10 is shown in the Figures to include a drilling tool storage device 16 having a laterally translatable carriage 18. The carriage 18 is shown to include a drilling tool storage cassette 20 (e.g. cartridge, compartment, magazine, etc.) having storage receptacles 62 (e.g. "slots," etc.) that store a plurality of drilling tools 22 (shown by way of example in the Figures as four [4] drilling tools 22) in a substantially linear array that has a low profile that is intended to fit conveniently beneath (or otherwise in cooperation with) a platform 24 of the drilling rig 100 adjacent to a drill tower 26 (see FIGS. 2-15). The cassette 20 is removably replaceable from the carriage 18 so that new cassettes with new or other types of drilling tools may be readily installed to suit a particular application or drilling plan.

Referring to FIGS. 1-15, certain components of the drilling rig 100, including the drill tower 26, a drill motor 28, shock absorbers 30, drill extenders (e.g. drill pipes 32, rods, etc.) and drilling tools 22 (e.g. drill bits, hammering tools, etc.) are shown according to an exemplary embodiment. The drill tower 26 includes an upper end 34 (shown in FIG. 1) configured to support the drill motor 28 and related components, and a lower end 36 (shown in FIG. 1) configured to be pivotally supported on the platform 24 for rotation between a substantially vertical orientation (i.e. a drilling orientation, shown in FIGS. 2-5) and a change-out orientation (e.g. disposed at an angle within a range of approximately 30-70 degrees, and more particularly at an angle of approximately 54 degrees from a drill hole axis [the "change-out angle"]) (shown by way of example in FIGS. 6-13), which may be substantially vertical, or may be disposed in a non-vertical orientation depending on a particular application. According to other embodiments, other change-out angles may be used as may be determined to be preferable. Movement of the drill tower 26 between the drilling orientation and the change-out orientation is facilitated by one or more actuators 38, shown by way of example as hydraulic cylinders in FIG. 1 that are provided with a supply of pressurized hydraulic fluid from a hydraulic system (not shown) associated with the drilling rig 100. Operation of the actuators 38 for positioning the drill tower 26 may be accomplished using suitable valves and instruments that operate in response to signals or other instructions received from the drilling control device 12.

Referring further to FIGS. 1-15, the automatic drilling tool changer apparatus 10 having a deployable, linearly-configured drilling tool storage device 16 for use with the drilling rig 100 (or the like) is also shown according to an exemplary embodiment. The drilling tool changer apparatus 10 as illustrated in the exemplary embodiments includes the drill tower 26 with actuators 38 for pivotally rotating the drill tower 26 between the drilling orientation and the change-out orientation, and the linearly-configured drilling tool storage device 16 that is pivotally movable about a forward hinge axis 52 (shown in FIGS. 8-15) from a stowed position (shown in FIGS. 2-5) during drilling operations to a deployed position (shown in FIG. 8) during drilling tool change-out. In the deployed position, the storage device 16 is oriented at approximately the same change-out angle as the drill tower 26 and is aligned in a substantially co-planar manner with the drill tower 26 (e.g. with the forward hinge axis 52 perpendicularly bisecting the drill pipe axis when in the change-out orientation), so that the drill pipe 32 and the drilling tools 22 (e.g. the 'used' drilling tool 22 to be replaced, and the 'new' [replacement] drilling tool 22 to be installed) are substantially coaxial with one another when the applicable storage receptacles 62 in the cassette 20 are indexed into coaxial alignment with the drill pipe 32.

The drilling tool storage device 16 is constructed as a substantially rectangular frame arrangement 54 (i.e. frame) having suitable cross members 40 (shown in FIGS. 5-11) and the translatable carriage 18 for holding the cassette 20. The cassette 20 includes supports or storage receptacles 62 for supporting (i.e. holding, cradling, etc.) the drilling tools 22. Each storage receptacle 62 is shown to include anti-rotation elements 42, shown as shoulders that fit with flats 56 (i.e., slots or lands) on the drilling tools 22 (see FIG. 13) to prevent rotation of the drilling tools 22 while in the storage receptacles 62 (e.g. to resist the torque applied by the drill pipe 32 during detachment [e.g. separation, disengagement, etc.] of the used drilling tool 22 and attachment [e.g. connection, engagement, etc.] of the replacement drilling tool 22). The carriage 18 supporting the cassette 20 is laterally translatable within the drilling tool storage device 16 so that the storage receptacles 62 for each of the drilling tools 22 may be indexed into alignment with the drill pipe 32 during change-out operations. The multiple storage receptacles 62 within the cassette 20 are intended to permit establishing a drilling tool 22 change-out strategy adapted to suit a particular job site and/or drilling condition. For example, one or more locations may be intentionally empty and intended for receiving a used drilling tool 22 to be replaced. Other storage receptacles 62 may be loaded with a drill bit (or various drill bits having the same or different cutting characteristics) and sequentially arranged in a manner intended to best-suit the drilling operation. Other storage receptacles 62 may be loaded with hammering tool(s) or other suitable drilling tools 22 for use in the drilling operation.

Translation of the carriage 18 within the drilling tool storage device 16 is accomplished using a suitable actuator 58 (e.g. pneumatic cylinder, hydraulic cylinder, linear actuator, chain and sprocket, etc.) (shown by way of example in FIGS. 5-9) that is actuated using suitable valves, motors or the like that are controlled by signals or other instructions received from the drilling control device 12. The drilling tool storage device 16 is shown to be disposed within the platform 24 at a location proximate the drill tower 26 such that the drill pipe 32 aligns near an approximate center of the storage device 16. In this manner, the carriage 18 can be indexed laterally from one side to the other to position the desired storage receptacle 62 into coaxial alignment with the drill pipe 32. The location of the storage device 16 is also positioned so that when the drill tower 26 and the storage device 16 are moved to the change-out orientation, there is sufficient clearance with the drill tower 26 and drill pipe 32 to prevent interference or damage among the components. Movement of the storage device 16 about the forward hinge axis 52 between the stowed position and the deployed or change-out position is accomplished using suitable actuators 44 (e.g. pneumatic cylinders, hydraulic cylinders, linear actuators, etc.) (shown by way of example in FIGS. 8-11) that are actuated using suitable valves, motors or the like that are controlled by signals or other instructions received from the drilling control device 12.

Referring further to FIGS. 2-15, the storage device 16 is also shown to include one or more cassette access (cover) panels 46 (shown first in FIG. 2), which when in the stowed position provide a substantially uniform work surface on the platform 24 and protect the storage device 16 from contaminants and other possible sources of damage, etc. The cassette access panels 46 may be deployable between an open position (shown in FIGS. 5-14) and a closed position (shown in FIGS. 2-4) as needed to permit the drilling tools 22 to be attached and detached from the drill pipe 32. According to the illustrated embodiment, the storage device 16 raises and lowers the drilling tool 22 (supported in the applicable storage receptacle 62) into coaxial alignment with the drill pipe 32 and the drill pipe 32 extends, retracts and rotates (both clockwise and anti-clockwise) as required to detach the used drilling tool 22 and to attach the new or replacement drilling tool 22, such that the drilling tool 22 enters and releases from a 'top' (according to FIG. 8) of the storage device 16.

Referring to FIGS. 16-19, a control scheme 48 for use by the drilling control device 12 to operate and control the automatic drilling tool changer apparatus 10 is shown according to an exemplary embodiment. In this embodiment, an operator or user selects the desired drilling tool 22 and initiates the automatic drilling tool change-out operation (e.g. by touching a 'start' button on the user interface of the drilling control device 12). Once initiated, the control scheme 48 for the automatic drilling tool change-out operation includes engaging a drill pipe positioner to the drill string 14 to align and support its vertical position, then positioning (e.g. moving up or down depending on the current position) the used drilling tool 22 of the drill string 14 in a first (e.g. breakout) depth position (shown in FIG. 3) to align with a deck wrench 60 (see FIG. 3) by using a precise hydraulically compatible positioning control method.

Figure 17:
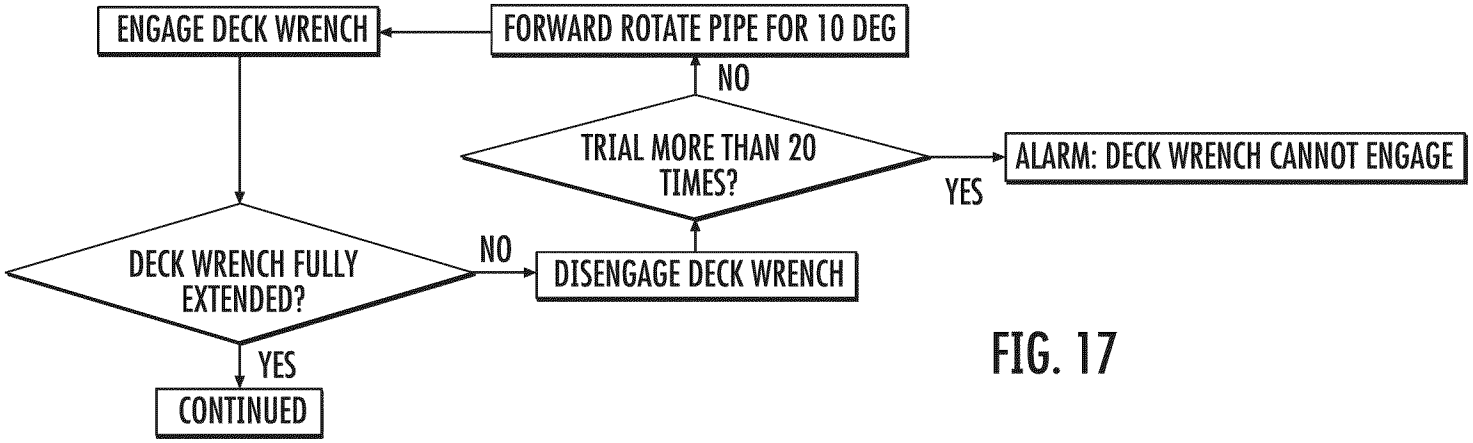
FIG. 17 is a flow chart of a portion of the control scheme shown in FIG. 16, according to an exemplary embodiment.
Figure 18:
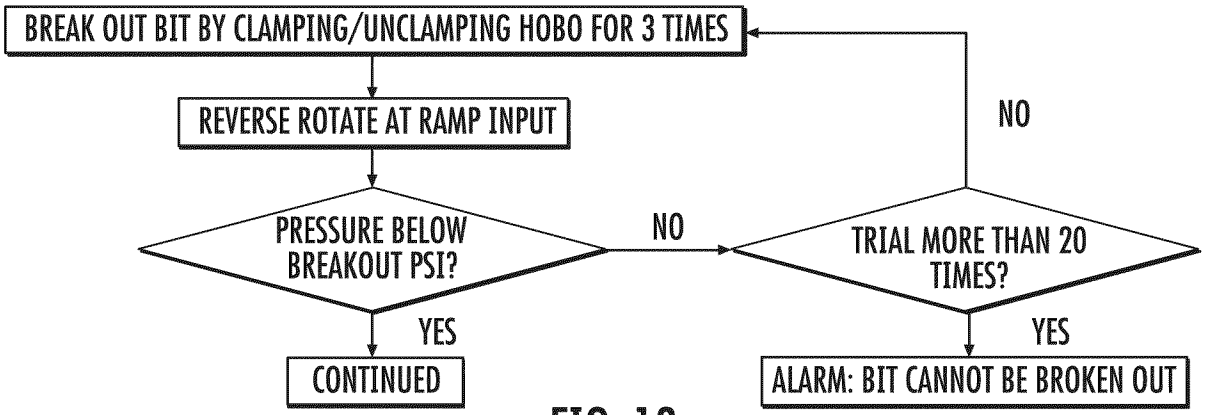
FIG. 18 is a flow chart of another portion of the control scheme shown in FIG. 16, according to an exemplary embodiment.

The control scheme 48 also includes engaging the deck wrench 60 on the used drilling tool 22. As shown in FIG. 17, engaging the deck wrench 60 may include verifying that the deck wrench 60 is fully extended by examining the sensor signal output from a linear transducer. If the deck wrench 60 is fully extended, the deck wrench 60 is engaged and no further action is needed to engage the deck wrench 60. If the deck wrench 60 is not fully extended, then the control scheme 48 includes disengaging the deck wrench 60, then determining if more than twenty (20) trials to engage the deck wrench 60 were attempted. If more than 20 trials were attempted, then the control scheme 48 includes initiating an alarm indicating that the deck wrench 60 is unable to engage to the drilling tool 22. If less than 21 trials were attempted, then the control scheme 48 includes forward rotating the drill pipe 32 10 degrees by using the precise hydraulically compatible positioning control method and again verifying that the deck wrench 60 is fully extended. In this embodiment, the control scheme 48 includes repeating the steps of FIG. 17 as needed until the deck wrench 60 is engaged.

Figure 19:
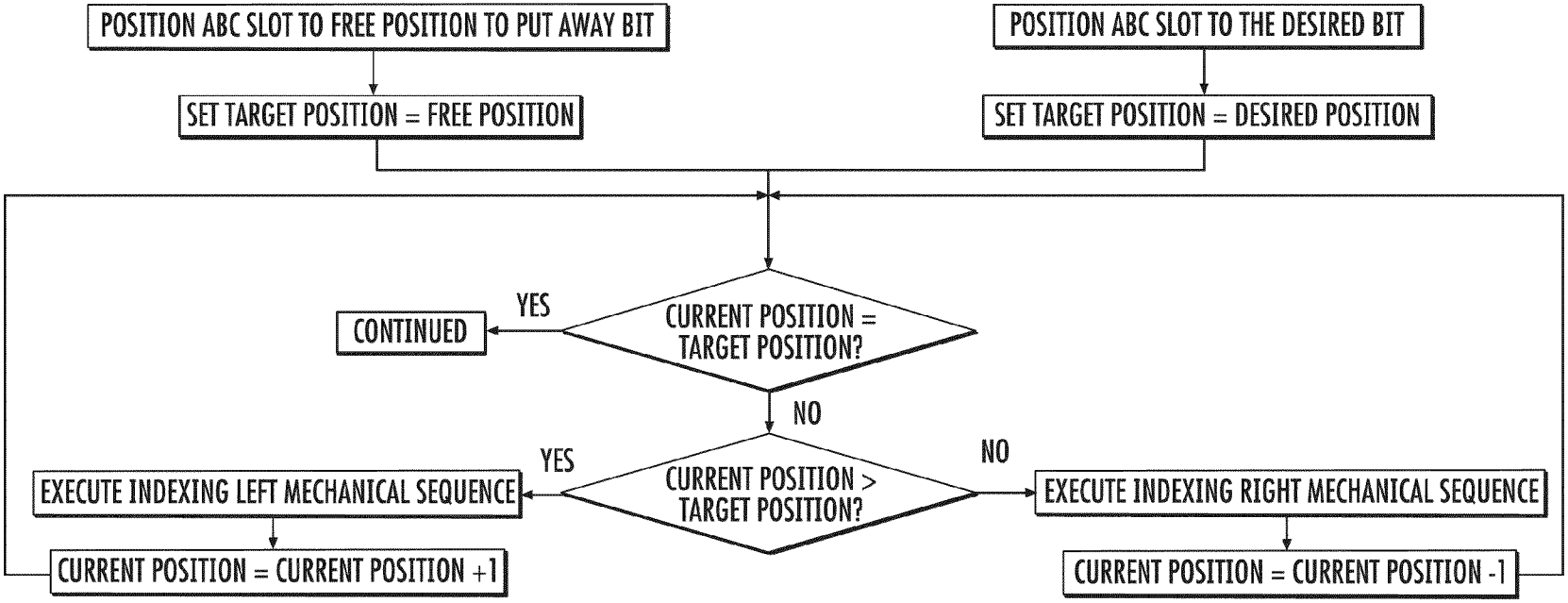
FIG. 19 is a flow chart of another portion of the control scheme shown in FIG. 16, according to an exemplary embodiment.

According to the illustrated embodiment of FIGS. 16-19, the control scheme 48 for the automatic drilling tool change-out operation further includes positioning the carriage 18 of the storage device 16 to a 'free' storage receptacle 62 or 'slot' to receive the used drilling tool 22, which may include the additional logics or steps of FIG. 19. According to FIG. 19, positioning the carriage 18 includes setting the target storage receptacle position ('slot') to a free slot position or storage receptacle 62; checking to see if the free slot 62 is currently aligned with the drill pipe 32. If the free slot 62 is currently aligned with the drill pipe 32, no further action is needed to position the carriage 18 to the free storage receptacle 62. If the free slot 62 is not currently aligned with the drill pipe 32, then the control scheme 48 includes verifying if the target slot location is greater than (e.g. beyond) the slot 62 currently aligned with the drill pipe 32. If the target slot location is greater than the slot 62 currently aligned with the drill pipe 32 (i.e., the aligned storage receptacle 62), then the control scheme 48 includes executing the left indexing hydraulically controlled mechanical sequence until a slot 62 in which 'string encoder sensed current position=current position (plus)+1'. If the target slot location is not greater than the slot 62 currently aligned with the drill pipe 32, then the control scheme 48 includes executing the right indexing hydraulically controlled mechanical sequence until a slot 62 in which 'string encoder sensed current position=current position (minus)−1'.

The control scheme 48 further includes breakout of the used drilling tool 22 by clamping/unclamping a hydraulically operated breakout wrench (HOBO wrench, not shown) (i.e., clamping/unclamping the drill pipe 32 using the HOBO wrench in conjunction with the hydraulic deck wrench 60 holding the drilling tool 22 by the flats 56) for three times. According to FIG. 18, breaking out the used drilling tool 22 includes reverse rotating the drill pipe 32 to verify that a pressure (e.g., measured as the pressure required to turn the hydraulic drill motor 28) is below drilling tool breakout pressure (approximately 1000 psi). If the pressure is below the drilling tool breakout pressure, then the control scheme 48 includes forward rotating the drill pipe 32 to align the flats 56 (i.e., used drilling tool flats) on the drilling tool 22 parallel to the edges of the deck wrench 60 (i.e., deck wrench edges). If the pressure is not below the drilling tool breakout pressure, then the control scheme 48 includes to retry clamping and unclamping the HOBO wrench three times and rechecking (i.e., verifying the pressure required to turn drill motor 28) for a limit of twenty (20) more times. If the pressure is still not below the drilling tool breakout pressure (approximately 1000 psi), then the control scheme 48 includes stopping and initiating an alarm that the drilling tool 22 is unable to breakout using the HOBO wrench and the hydraulic deck wrench 60.

According to the illustrated embodiment of FIGS. 16-19, the control scheme 48 further includes forward rotating the drill pipe 32 to align flats 56 on the drilling tool 22 parallel to the deck wrench edges using a precise hydraulically compatible positioning control method, disengaging the deck wrench 60, further withdrawing the drill pipe 32 and drilling tool 22 to a retracted position above the drill hole using a precise hydraulically compatible positioning control method, and pivotally rotating the drill mast (i.e., drill tower 26) from the drilling orientation to the change-out orientation (approximately 54 degrees from the drill hole axis). The control scheme 48 also includes moving the cassette access panel/door (i.e., cassette access panel 46) from the closed position to the open position, extending the drill pipe 32 and the drilling tool 22 to a change-out position above the storage device 16 using a precise hydraulically compatible positioning control method, pivotally raising the storage device 16 from a stowed position to a change-out position (i.e., device change-out position) substantially aligned with the drill pipe 32 and cradling the used drilling tool 22 in the empty slot 62. Further, the control scheme 48 includes uncoupling (i.e., un-screwing or de-coupling) the used drilling tool 22 from the drill pipe 32 by coordinated rotation and withdrawal velocity of the drill pipe 32 by using a precise hydraulically compatible positioning control method, then indexing the carriage 18 to the slot 62 containing the desired replacement drilling tool 22.

According to FIG. 19, in order to index the carriage 18 to the slot 62 containing the desired replacement drilling tool 22, the control scheme 48 may include setting the target storage receptacle position ('slot') to the free slot position, and checking (i.e., verifying) that the free slot 62 is currently aligned with the drill pipe 32. If the free slot 62 is currently aligned with the drill pipe 32, no further action is needed to index the carriage 18 to the slot 62 containing the desired replacement drilling tool 22. If the free slot 62 is not currently aligned with the drill pipe 32, then the control scheme 48 includes checking (i.e., verifying) that the target slot location is greater than (e.g. beyond) the slot 62 currently aligned with the drill pipe 32. If the target slot location is greater than the slot 62 currently aligned with the drill pipe 32, then the control scheme 48 includes executing the left indexing hydraulically controlled mechanical sequence until a slot 62 in which 'string encoder sensed current position=current position (plus)+1'. If the target slot location is not greater than the slot 62 currently aligned with the drill pipe 32, then the control scheme 48 includes executing the right indexing hydraulically controlled mechanical sequence until a slot 62 in which 'string encoder sensed current position=current position (minus)−1'.

Referring again to FIG. 16, the control scheme 48 further includes coupling the replacement drilling tool 22 to the drill pipe 32 by coordinated rotation and feed/extend velocities by using a precise hydraulically compatible position and velocity control method, lowering the storage device 16 from the change-out position to the stowed position, withdrawing the drill pipe 32 and replacement drilling tool 22 to the retracted position above the drill hole by using a precise hydraulically compatible positioning control method, and moving the cassette access panel/door (i.e., cassette access panel 46) from the open position to the closed position. The control scheme 48 also includes pivotally moving the drill tower 26 from the change-out orientation to the drilling orientation, extending the drill pipe 32 and replacement drilling tool 22 to the breakout position by using a precise hydraulically compatible positioning control method, and engaging the deck wrench 60

Referring again to FIG. 17, in order to engage the deck wrench 60, the control scheme 48 may include checking (i.e., verifying) that the deck wrench 60 is fully extended by examining the sensor signal output from a linear transducer (not shown). If the deck wrench 60 is fully extended, no further action is needed to engage the deck wrench 60. If the deck wrench 60 is not fully extended, then the control scheme 48 includes disengaging the deck wrench 60, then checking or determining if more than 20 trials (to engage the deck wrench 60) were attempted. If more than 20 trials were attempted, then the control scheme 48 includes initiating an alarm that the deck wrench 60 is unable to engage to the drilling tool 22. If less than 21 trials were attempted, then the control scheme 48 includes forward rotating the drill pipe 32 for 10 degrees by using a precise hydraulically compatible positioning control method and then re-checking or determining if the deck wrench 60 is fully extended and repeating the steps as needed in order to engage the deck wrench 60.

Once the deck wrench 60 is engaged, the control scheme 48 for use by the drilling control device 12 to operate and control the automatic drilling tool changer apparatus 10 includes forward rotating the drill pipe 32 up to a torque-up pressure (e.g. approximately 1500 psi) to tighten the replacement drilling tool 22 on the drill pipe 32, reverse rotating the drill pipe 32 to align the flats 56 on the replacement drilling tool 22 (i.e., the replacement drilling tool flats) with the deck wrench edges by using a precise hydraulically compatible positioning control method, and retracting the deck wrench 60. Once the above contemplated steps are completed, the drilling tool change-out is complete and the drilling rig 100 is ready to re-commence drilling operation.

The control scheme 48 is also configured to accommodate a situation where there is currently no drilling tool 22 on the drill string 14, but a replacement drilling tool 22 is to be installed from the cassette 20. The control scheme 48 is also configured to accommodate a situation where a used drilling tool 22 will be removed from the drill pipe 32 and stored in the cassette 20, but no replacement drilling tool 22 will be presently installed.

If there are more than one free storage receptacles 62 in the cassette 20, then the control scheme 48 determines the loading position for a used drilling tool 22 based on the least movement of the carriage 18.

Figure 20:
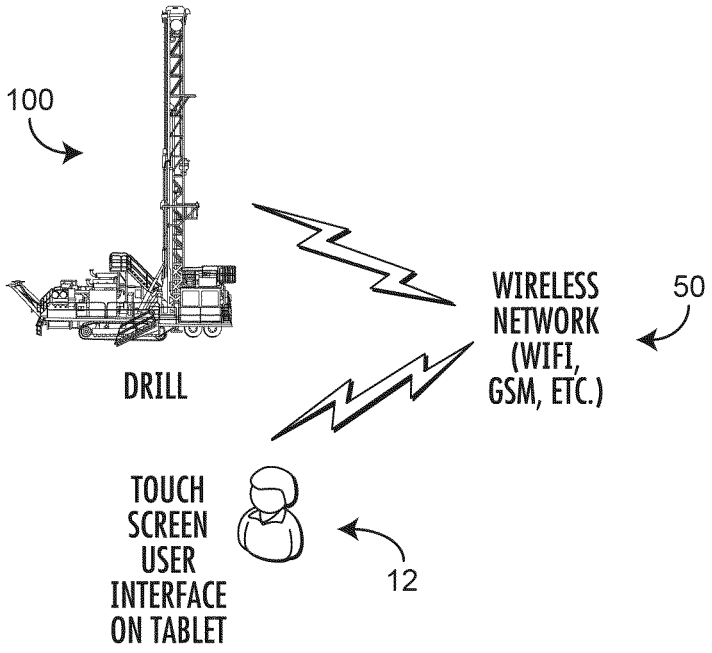
FIG. 20 is a diagram of a communication scheme between the drilling control device and the automatic drilling tool changer apparatus, according to an exemplary embodiment.

Referring now to FIG. 20, the communication relationship for the drilling control device 12 to communicate the control scheme 48 to the automatic drilling tool changer apparatus 10 is illustrated in a block diagram format, according to an exemplary embodiment. The drilling control device 12 is shown by way of example to be a hand-held tablet computer (e.g., hand-held touch screen) accessible by an authorized user for communicating with the automatic drilling tool changer apparatus 10 over a wireless network (e.g., network 50) using Wi-Fi or GSM (or other suitable network). The drilling control device 12 includes a user interface (e.g. touch screen, etc.) and is programmed with a control scheme (e.g., control scheme 48) that provides options for a user to initiate the automatic drilling tool change-out operation, and to provide various screen images (e.g. "screenshots") that present information on the operation of the drilling rig 100, the automatic drill changer tool apparatus 10 and the drilling tools 22, and permit the user to interactively monitor the status and operation of the apparatus 10 and to initiate, control, and/or terminate the change-out operation and to troubleshoot any problems identified with the apparatus 10. The user interface of the drilling control device 12 permits the operator to choose the drilling tool 22 to be logged and to keep track of the history and status of the various tools (e.g., drilling tools 22) used by the drilling rig 100 and/or stored in the storage device 16 of the apparatus 10. According to one embodiment, the drilling control device 12 uses JAUS messages over UDP to implement all aspects of the control scheme 48 for operating the drilling rig 100 and the tool changer apparatus 10.

Figure 21:
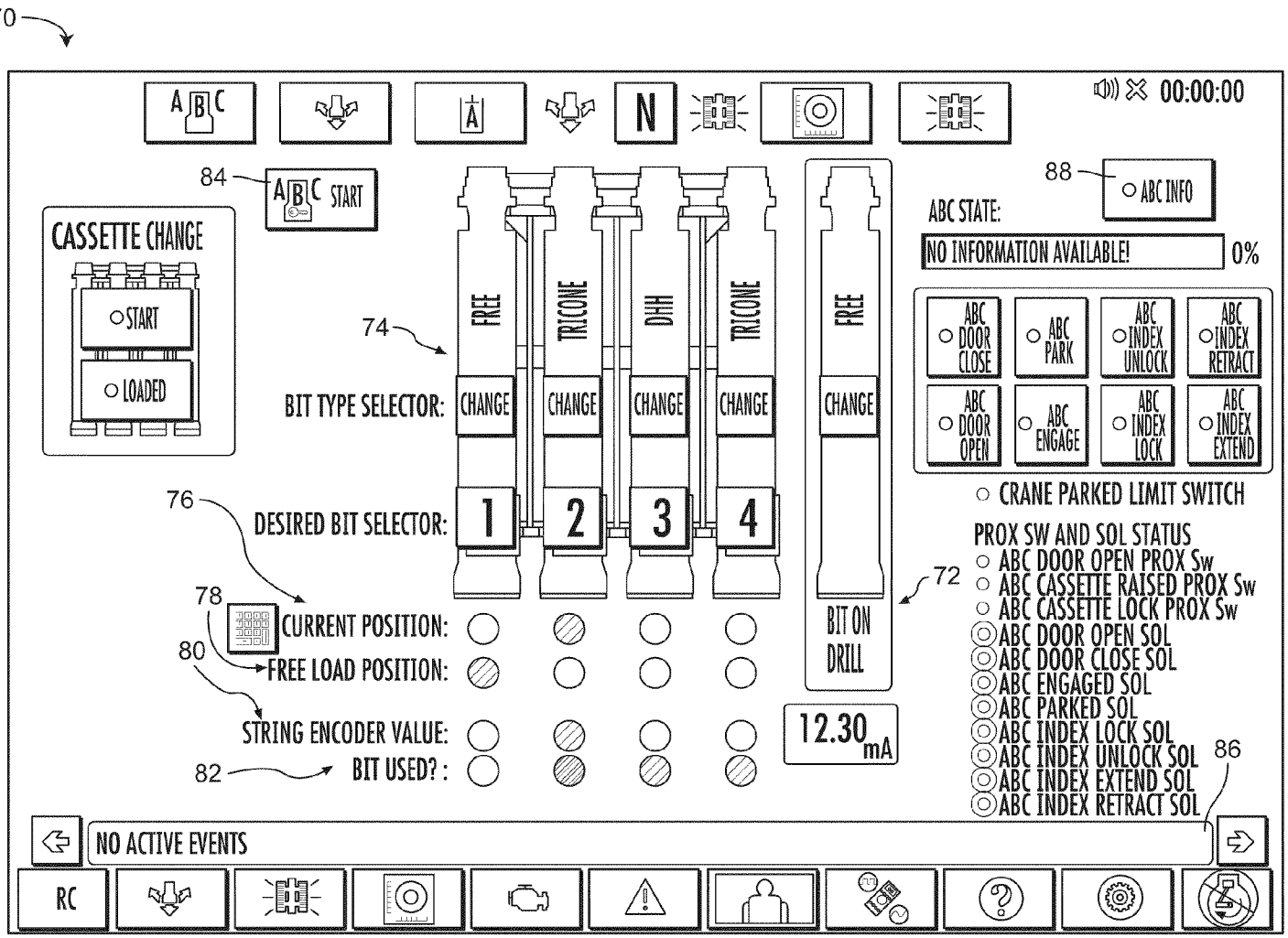
FIG. 21 is an image of a screenshot on a graphical user interface portion of the drilling control device of FIG. 20, according to an exemplary embodiment for initiating the drilling tool change-out operation.

Referring now to FIG. 21, a screen configuration 70 (i.e., screen image) accessible to a user on the user interface of the drilling control device 12 is shown according to an exemplary embodiment for initiating and monitoring operation of the automatic drilling tool changer apparatus 10 according to the control scheme 48. The screen configuration 70 of FIG. 21 illustrates a cassette 20 of the storage device 16 of the apparatus 10 having four storage receptacles 62 illustrated by storage receptacle indicators 74 (by way of example, and labeled 1, 2, 3 and 4), which are intended to inform the user of any open positions (e.g. "slots 62") for receiving a used drilling tool 22 and the replacement drilling tools 22 that are available for installation during change-out. Another receptacle indicator 72 is provided which identifies the drilling tool 22 that is currently installed in the drill string 14. The receptacle indicators 72 and 74 have portions coded with various alphanumeric designators of the tool type in each receptacle 62 (e.g. "tri" or "tricone" for a tricone rotary drill bit, "DHH" for a DHH hammer tool, or "free" to indicate an open receptacle 62 available to receive the used drilling tool 22, etc). Once a replacement drilling tool 22 has been installed, the drilling control device 12 automatically updates the tool information associated with each storage receptacle 62. An indicator 76 is provided to identify which of the storage receptacles 62 is presently in a position aligned with the drill pipe 32 as determined by the program logic. Another indicator 78 is provided to inform the operator the next free loading position for a used drilling tool 22 based on the least movement of the carriage 18. Another indicator 80 is provided to identify which of the storage receptacles 62 is presently in a position aligned with the drill pipe 32 based on feedback from a string encoder (not shown) mounted on the carriage 18. Indicators 82 are the colors (represented in FIG. 21 as line patterns) to convey whether the drilling tool 22 has been used (e.g. green=not used and black=used, or single line=not used and double line=used, etc.).

The screen configuration 70 may also provide 'buttons' configured to permit an operator to provide input to the control scheme 48 to initiate actions, such as one-touch operation button 84 (ABC START) for starting or stopping the automatic drilling tool change-out operation. However, other actions may be directed by a user via the interface (i.e., the drilling control device 12) including (by way of example) actuating (e.g. opening and closing) the cassette access panel 46 in the platform 24, actuating the storage device 16 by raising it from the stowed position to the change-out position (and vice-versa), and indexing the carriage 18 within the storage device 16 (e.g. locking and unlocking indexing capability, indexing forward/backward).

The screen configuration 70 of FIG. 21 also includes a window 86 where error messages may be received to alert the operator to an abnormal condition or occurrence with the apparatus 10 or other equipment on the drilling rig 100. According to one embodiment, fifty (50) circumstances giving rise to an error indication are included within the control scheme 48. In the event that any one or more error messages or alarm signals are received, the operator can scroll to the desired message or signal and touch one or more soft buttons (marked by way of example as "ABC Info 88") to obtain more information or details associated with the message or signal. Some examples of the information or details associated with the message or signal include drill rig jacked and level status, deck crane parked status, drilling tool (e.g. "bit") air pressure level and/or alarm, deck wrench engagement status, break-out connection status, hydraulically operated breakout (HOBO) engagement status, deck wrench position and/or status, cassette access panel/door position and/or status, drill tower/mast position and/or status, apparatus cassette position and/or status, cassette carriage index position and/or status, and conflicts between storage receptacle loading and index position.

A number of other soft buttons are provided to permit an operator to activate or initiate other operations (e.g. in response to error messages or alarm signals, etc.), such as activating solenoids or other actuator components to open or close the cassette access panel 46, raise and lower the storage device 16, lock and unlock the carriage 18 within the storage device 16, index the carriage 18 forward or backward within the storage device 16, etc. (among others).

Figure 22:
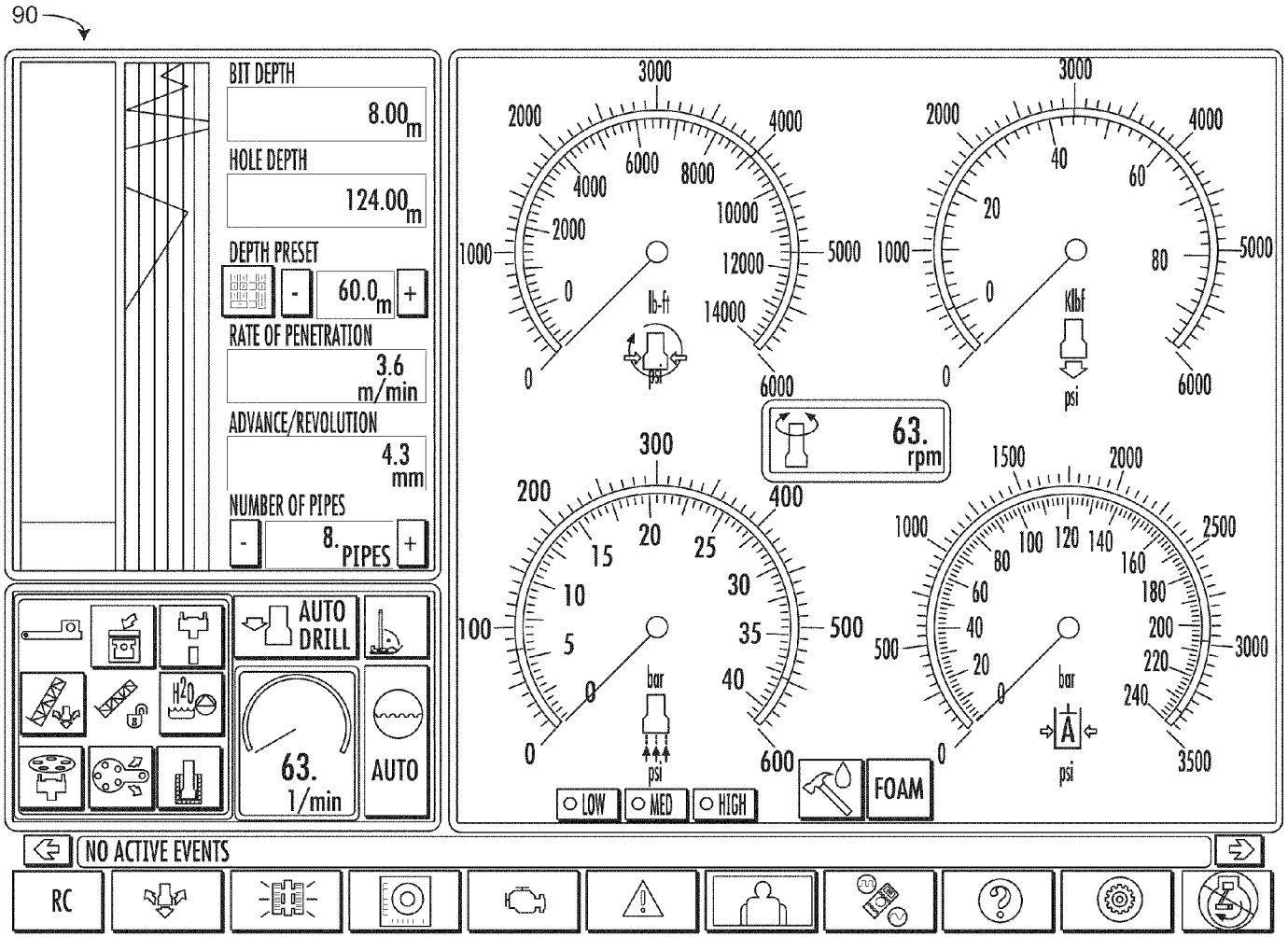
FIGS. 22-37 are images of other screenshots on a graphical user interface portion of the drilling control device of FIG. 20, according to an exemplary embodiment.
Figure 23:
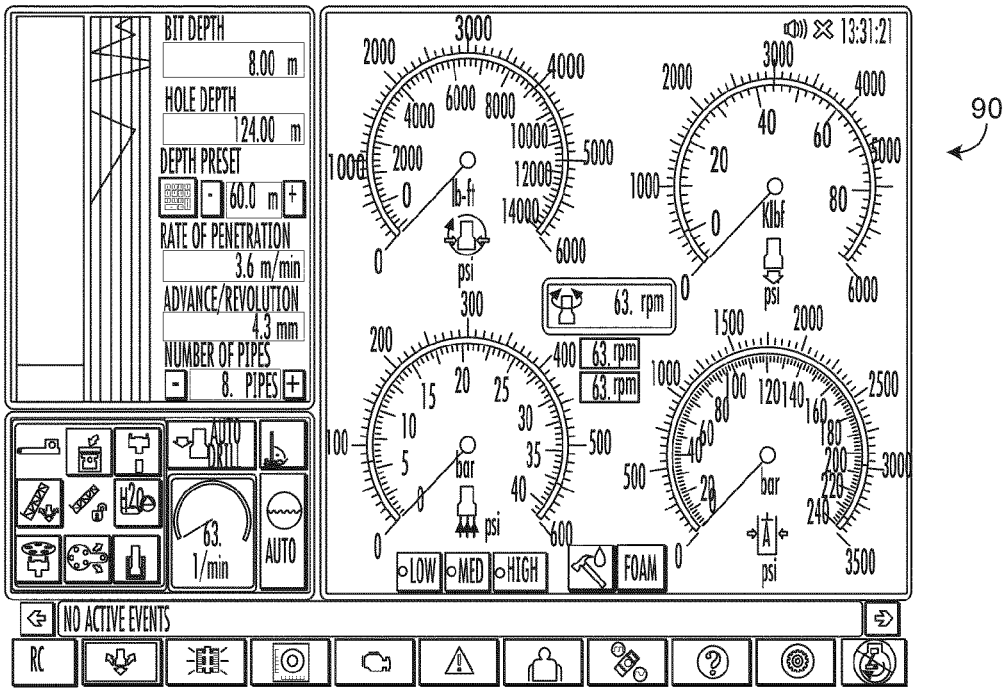
Figure 24:
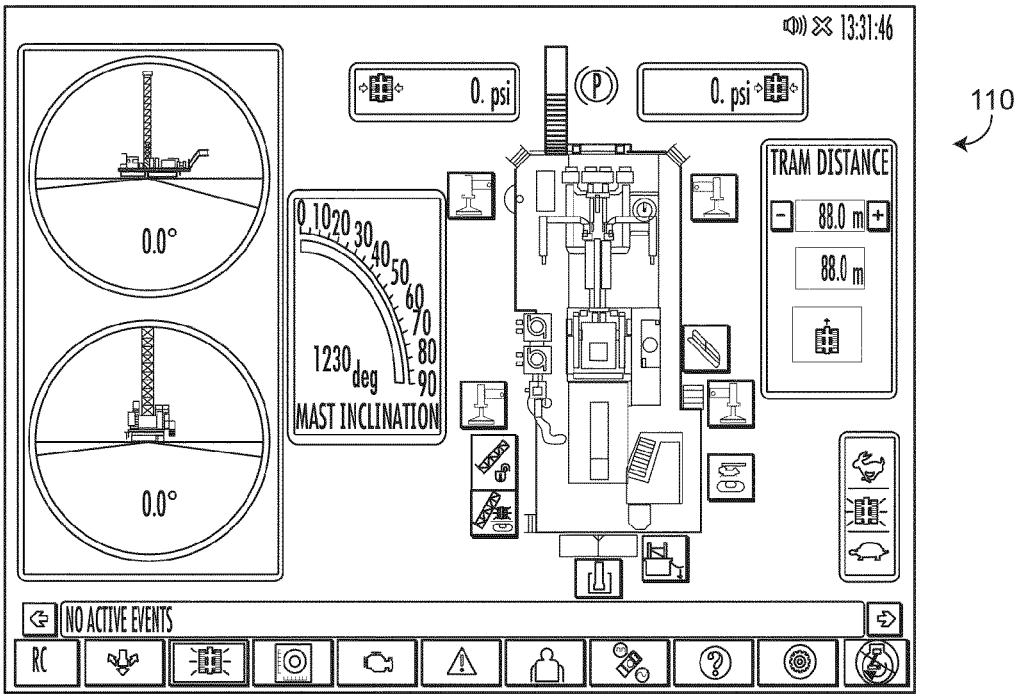
Figure 25:
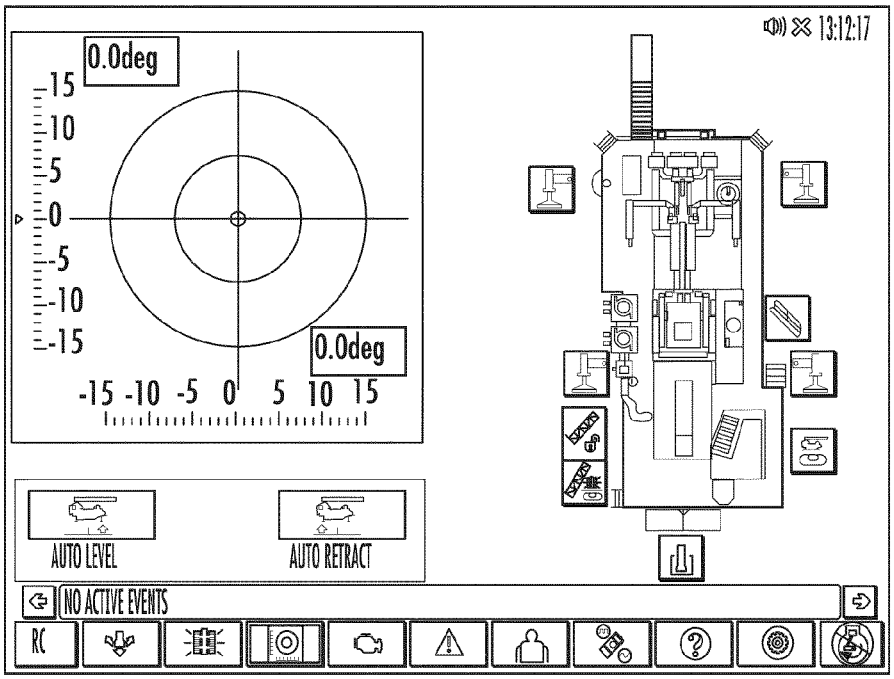
Figure 26:
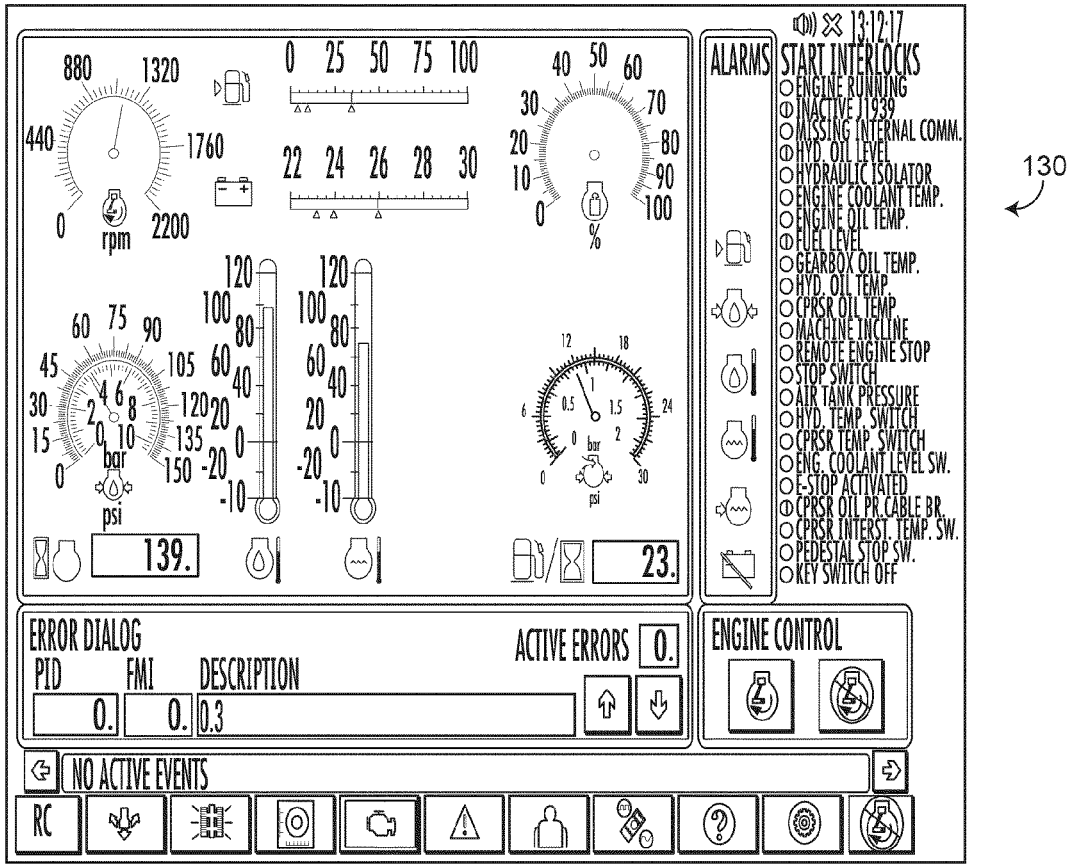
Figure 27:
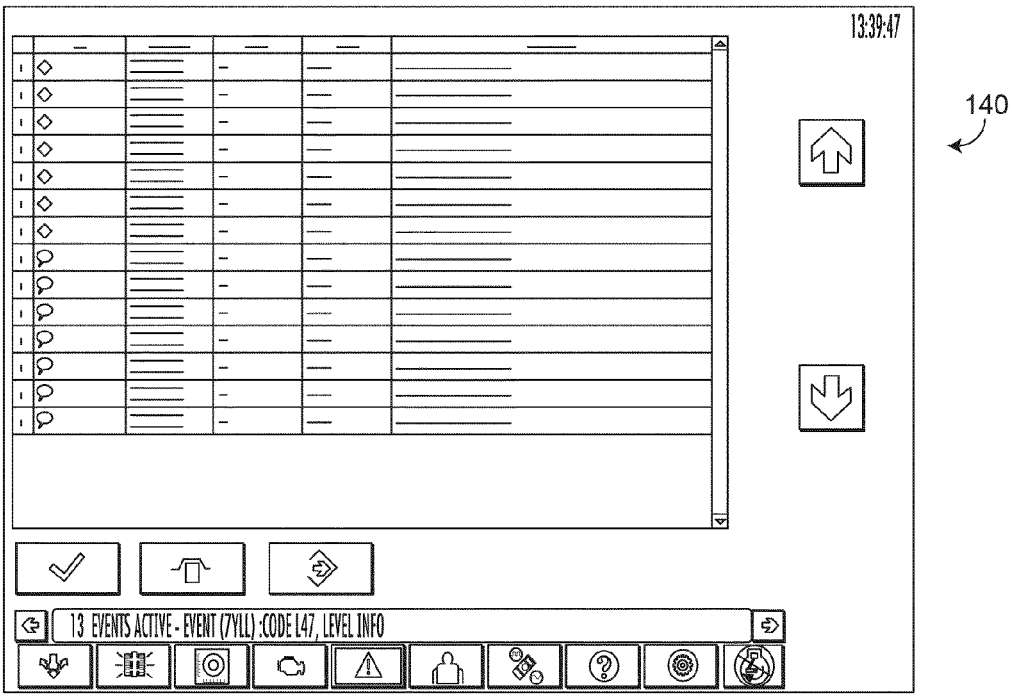
Figure 28:
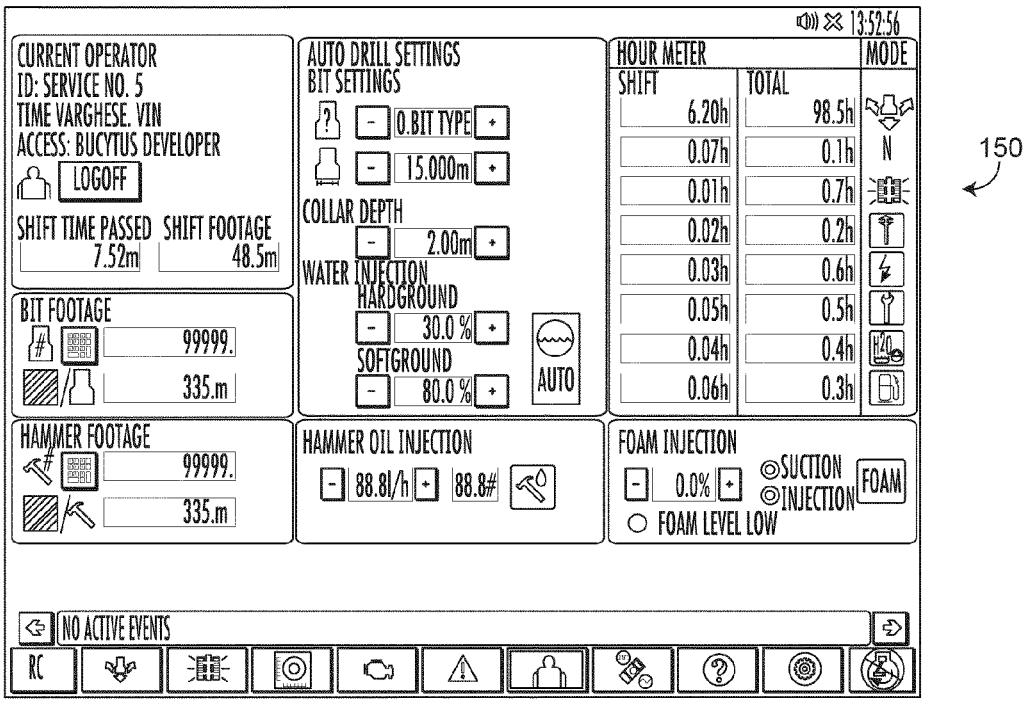
Figure 29:
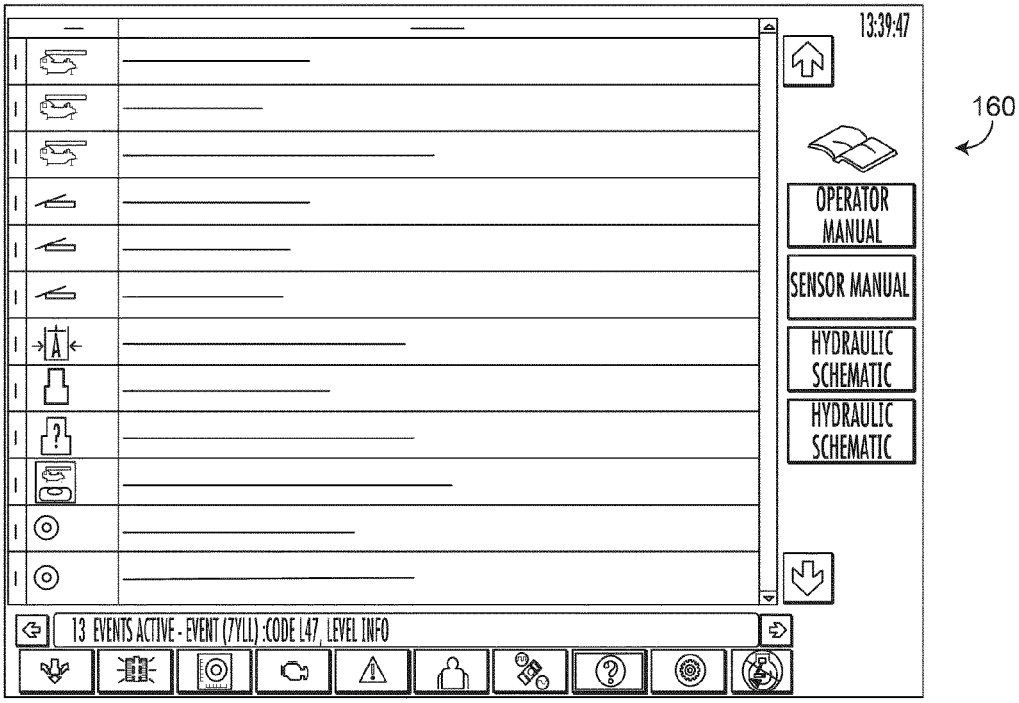
Figure 30:
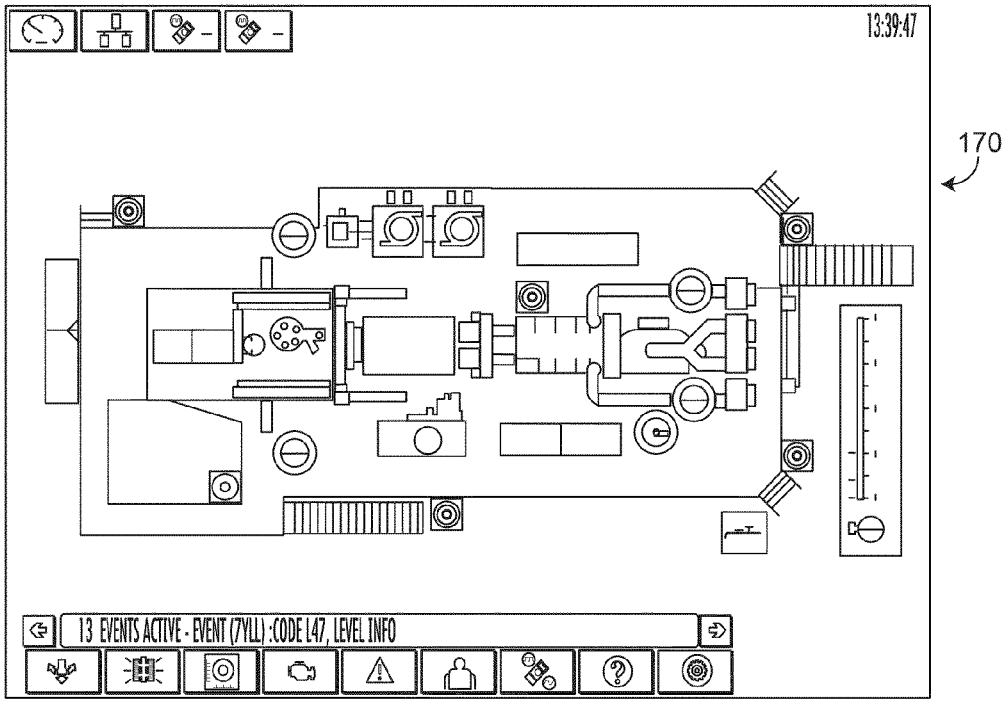
Figure 31:
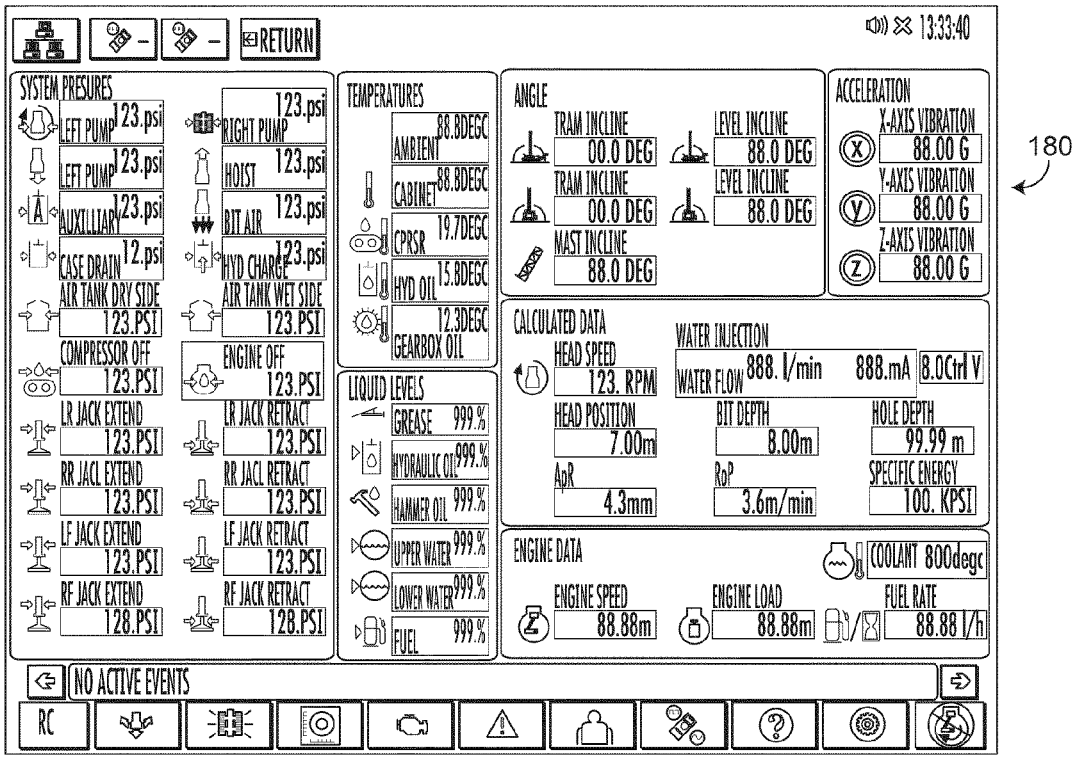
Figure 32:
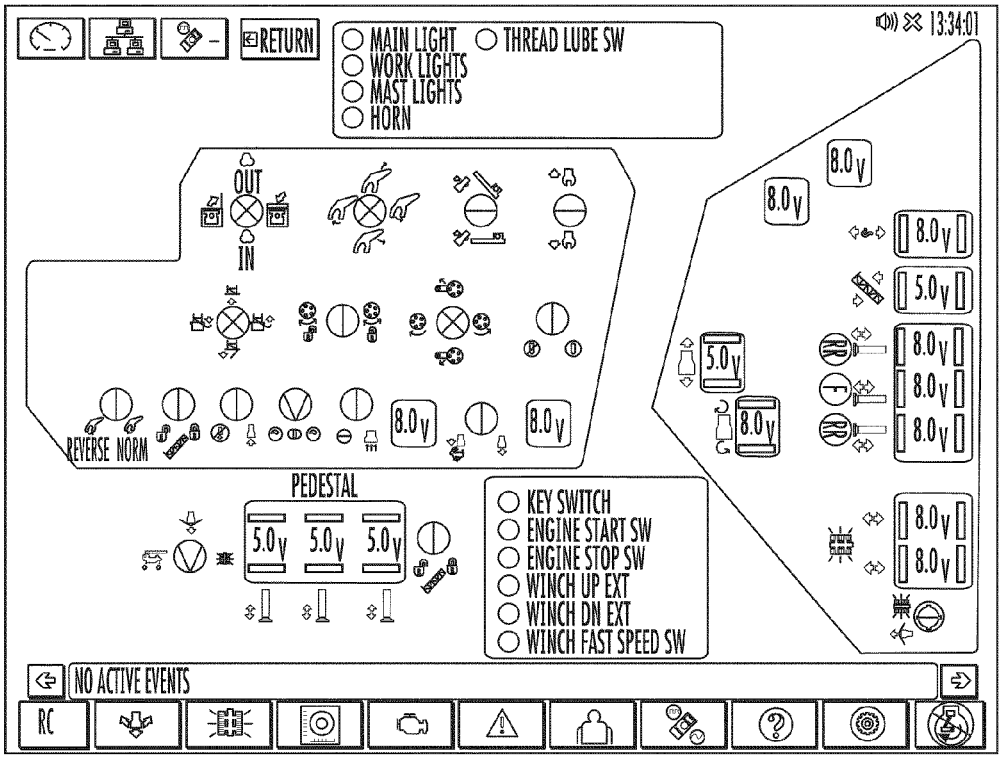
Figure 33:
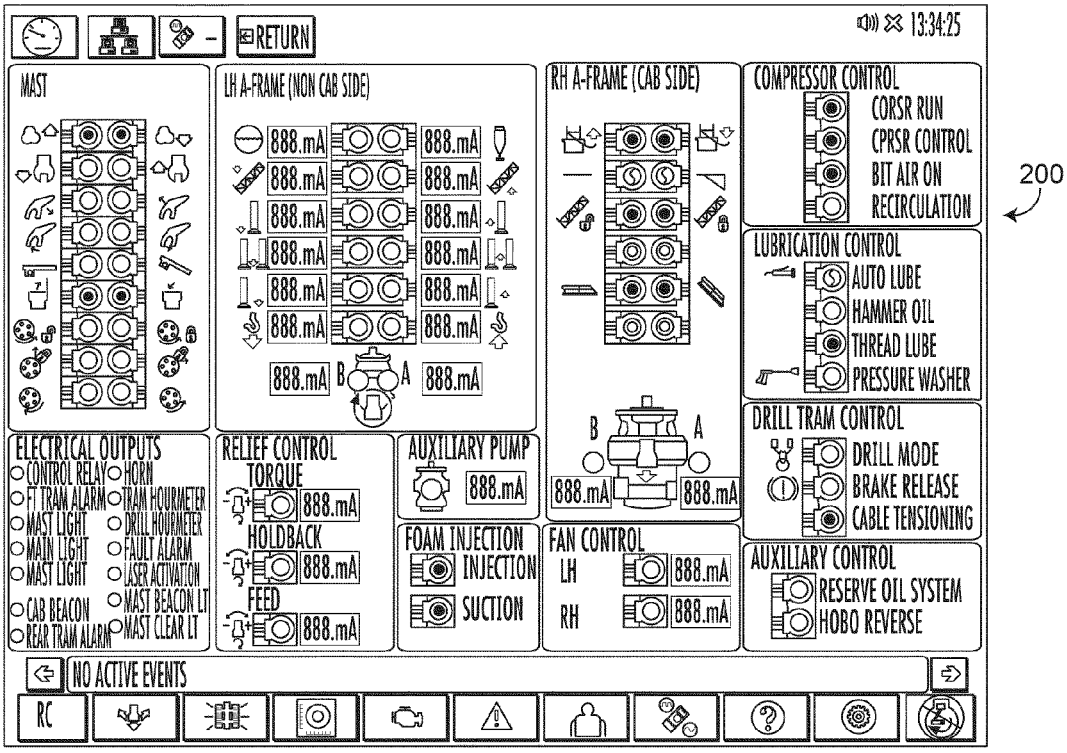
Figure 34:
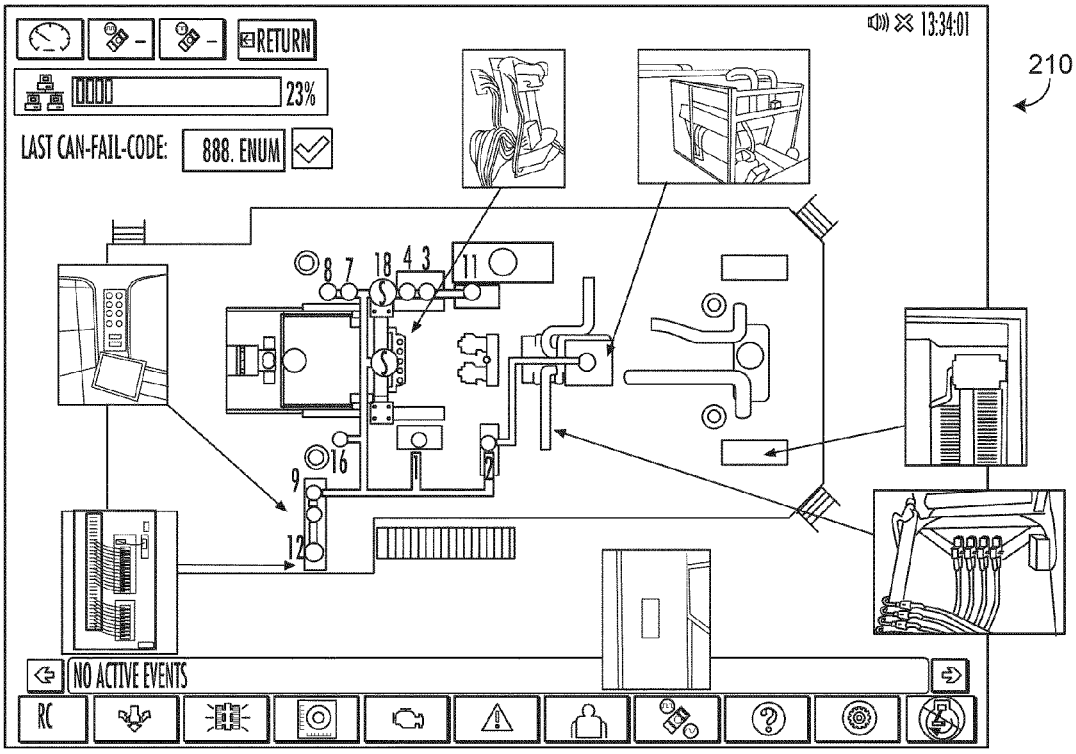
Figure 35:
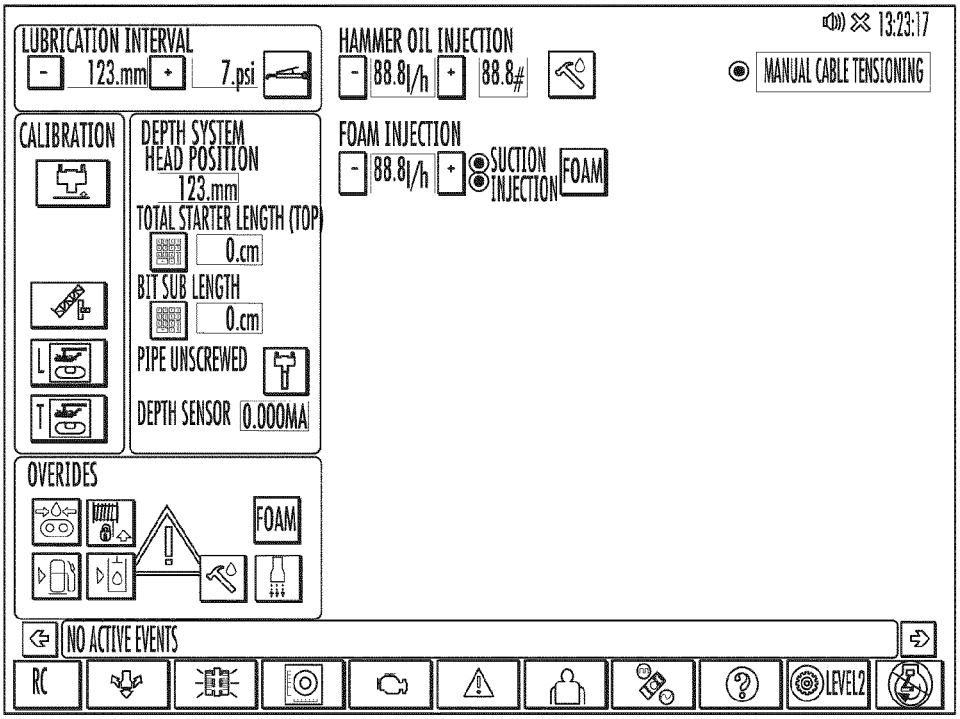
Figure 36:
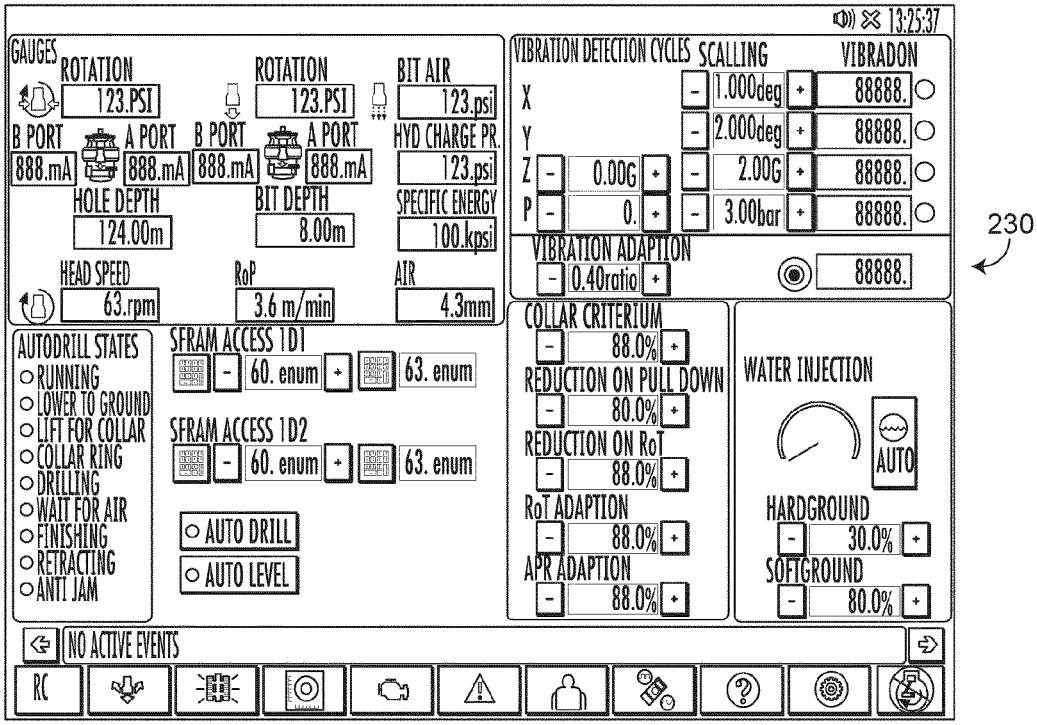
Figure 37:
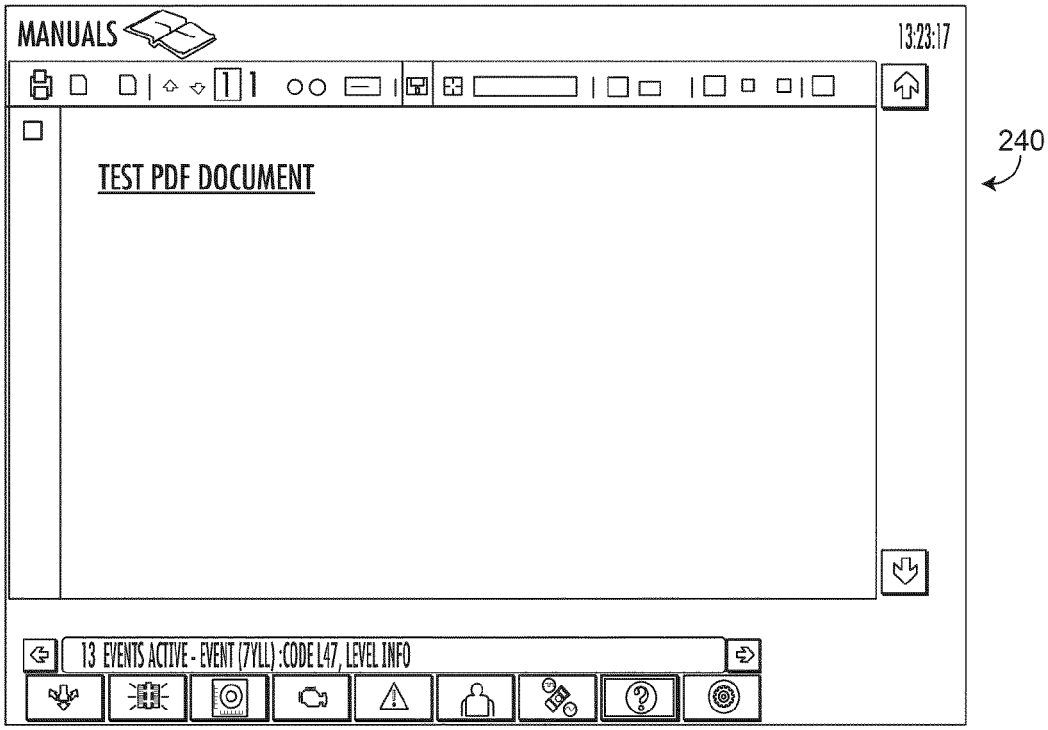

Referring now to FIGS. 22-37, other screen configurations accessible to a user on the user interface of the drilling control device 12 are shown according to an exemplary embodiment for initiating and monitoring operation of the automatic drilling tool changer apparatus 10 and/or other components of the drilling rig 100, according to the control scheme 48. FIG. 22 provides an example of a 'drill' screen 90 providing detailed parameter and other information to an operator on the status and operation of the drill (e.g., drilling rig 100), including drill progress, parameter and preset inputs, system health gauges, active override warning signals and global active event notifications. FIGS. 23-26 provide examples of the drill screen 90 and several other screens including a tram status screen 110, a leveling screen 120 and an engine status screen 130. FIGS. 27-30 provide examples of several other screens, including an events and information screen 140, an operator screen 150, an icon and symbols screen 160, and a drilling rig general status screen 170. FIGS. 31-34 provide examples of several other screens, including a machine health sensor readout screen 180, a cab dashboard screen 190, an electrical cabinet screen 200, and an electrical and computing status screen 210. FIGS. 35-37 provide examples of several other screens, including a calibration screen 220, an advanced settings screen 230, and a PDF display screen 240.

According to an exemplary embodiment, a control system and method for controlling the operation of an apparatus 10 for automatically changing-out drilling tools (e.g., drilling tool 22) is provided that includes a pivotally movable drill tower 26 that cooperates in coordination with a pivotable drilling tool storage device 16 having a laterally translatable carriage 18 with a cassette 20 including storage receptacles 62 to receive the used (drilling) tools 22 from the drill pipe 32 and to present replacement (drilling) tools 22 for attachment to the drill pipe 32. The control scheme 48 of the system method according to the present disclosure operates to accomplish the operation of one or more steps in any appropriate sequence. The steps include identifying and/or selecting a desired replacement drilling tool 22 to be loaded on the drill pipe 32 during the drilling operation, withdrawing the drilling tool 22 from the drill hole to a break-out position, breaking-out (e.g. loosening) the used drilling tool 22 from the drill pipe 32, withdrawing the drilling tool 22 further to a refracted position, moving the cassette access panel 46 from a closed position to an open position, pivoting the drill tower 26 from a drilling orientation to a change-out orientation (e.g. at a change-out angle of approximately 54 degrees), extending the drilling tool 22 to a change-out position, raising the drilling tool storage device 16 from a stowed position to a deployed position (e.g. at the change-out angle) to receive and cradle the used drilling tool 22 in an empty storage receptacle 62 within the cassette 20, rotating the drill pipe 32 to de-couple the drill pipe 32 from the used drilling tool 22, and withdrawing the drill pipe 32 to a standby position. The steps also include indexing the carriage 18 of the storage device 16 to align a replacement drilling tool 22 with the drill pipe 32, extending and rotating the drill pipe 32 into engagement with the replacement drilling tool 22, lowering the storage device 16 from the change-out (e.g. deployed) position to the stowed position, withdrawing the replacement drilling tool 22 and drill pipe 32 to the retracted position, moving the drill tower 26 from the change-out orientation to the drilling orientation, extending the replacement drilling tool 22 to the extended position and tightening the replacement drilling tool 22 on the drill pipe 32, and closing the cassette access panel 46 for the storage device 16 and re-commencing the drilling operation.

The control scheme 48 may be implemented using any suitable computing device with an appropriate user interface such as a touch screen to permit input of desired information (e.g. which replacement drilling tool 22 to use, when to initiate change-out, etc.) and appropriate software to store and implement the steps of the control scheme 48, and to communicate (e.g. wirelessly, etc.) via a network (e.g., network 50) with the apparatus 10 to provide operating instructions to the apparatus 10 and to receive feedback from the apparatus 10.

The drilling control device 12 of the present disclosure may implement the control scheme 48 using any machine-readable storage media for accomplishing the various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable storage media for carrying or having machine-executable instructions or data structures stored thereon. Such machine-readable storage media can be any available media that can be accessed by a general purpose or special purpose computer or other machine with a processor. By way of example, such machine-readable storage media can comprise RAM, ROM, EPROM, EEPROM, CD-ROM or other optical disk storage, magnetic disk storage or other magnetic storage devices, flash memory, or any other medium which can be used to carry or store desired program code in the form of machine-executable instructions or data structures and which can be accessed by a general purpose or special purpose computer or other machine with a processor. Machine-readable storage media are tangible storage media and are non-transitory (i.e., are not merely signals in space). Combinations of the above are also included within the scope of machine-readable storage media. Machine-executable instructions include, for example, instructions and data which cause a general purpose computer, special purpose computer, or special purpose processing machines to perform a certain function or group of functions.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

It should be noted that the orientation of various elements may differ according to other exemplary embodiments, and that such variations are intended to be encompassed by the present disclosure.

It is also important to note that the construction and arrangement of the control system and method for operating an automatic drilling tool changer apparatus as shown and described in the various exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter disclosed herein. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present invention as defined in the appended claims. The order or sequence of any process or method steps may be varied or re-sequenced according to alternative embodiments. Other substitutions, modifications, changes and omissions may be made in the design, operating conditions and arrangement of the various exemplary embodiments without departing from the scope of the present inventions.

INDUSTRIAL APPLICABILITY

The disclosed control system and method for operating an automatic drilling tool changer apparatus may be utilized in any drilling application or operation, including but not limited to mining, blast hole drilling petroleum operations or exploration, etc. The system and method include a drilling control device programmed with a control scheme or algorithm for controlling all aspects of the apparatus and other equipment associated with the drilling rig, and having a computer-based user interface (e.g. touch screen, etc.) for initiating actions and monitoring the status of equipment and operations related to the apparatus, and that wirelessly communicates via a network with the actuators and other components of the apparatus. The system and method are intended to reduce the downtime associated with changing drilling tools on a drilling rig, and to minimize the need for personnel to manually actuate or operate components of the drilling rig in order to accomplish the tool change.

It will be apparent to those skilled in the art that various modifications and variations can be made to the disclosed control system and method for operating an automatic drilling tool changer apparatus. Other embodiments will be apparent to those skilled in the art from consideration of the specification and practice of the disclosed control system and method. It is intended that the specification and examples be considered as exemplary only, with a true scope being indicated by the following claims and their equivalents.

What is claimed is:

1. A system for automatically changing a drilling tool for a drilling rig, the system comprising:

a drilling tool changer apparatus, comprising:

a pivotally movable drill tower supporting a drill pipe; and a pivotable drilling tool storage device comprising a laterally translatable carriage and a storage cassette having a storage receptacle for storing the drilling tool;

wherein the drilling tool storage device moves to position the drilling tool in coaxial alignment with the drill pipe;

a drilling control device programmed with a control scheme for controlling the drilling tool changer apparatus; and a user interface coupled to the drilling control device for initiating actions of the drilling tool changer apparatus and for interactively monitoring a status of the drilling tool changer apparatus;

wherein the control scheme includes steps for an automatic drilling tool change-out operation; and wherein the drilling control device and the user interface are configured to communicate with the drilling tool changer apparatus over a network.

2. The system of claim 1, wherein the user interface permits a user to initiate the automatic drilling tool change-out operation, and to terminate the automatic drilling tool change-out operation.

3. The system of claim 1, wherein the drilling control device receives feedback related to the drilling rig and the drilling tool changer apparatus from the drilling tool changer apparatus.

4. The system of claim 3, wherein the user interface includes a screen image for presenting the feedback to a user.

5. The system of claim 4, wherein the screen image includes a receptacle indicator that identifies a used drilling tool and a replacement drilling tool, and wherein the feedback includes tool information for the used drilling tool and the replacement drilling tool.

6. The system of claim 1, wherein the user interface is configured to communicate with the drilling tool changer apparatus wirelessly, and the network includes a wireless network.

7. The system of claim 6, wherein the user interface includes a hand-held touch screen.

8. The system of claim 1, wherein the drilling control device permits initiation of the automatic drilling tool change-out operation based upon a single instruction from a user.

9. A method for controlling a drilling tool chancier apparatus to automatically change out a drilling tool, the method comprising:

providing a drilling control device having a user interface;

wirelessly coupling the drilling control device to the drilling tool chancier apparatus by a network; and programming a control scheme including an automatic drilling tool change-out operation to the drilling control device, wherein the automatic drilling tool change-out operation includes:

aligning and supporting a drill pipe by engaging a drill pipe positioner to the drill pipe;

positioning a used drilling tool to a breakout position aligned with a deck wrench;

engaging the deck wrench on the used drilling tool;

positioning a drilling tool storage device and a carriage of the drilling tool storage device such that an empty storage receptacle of a storage cassette is able to receive the used drilling tool;

breaking out the used drilling tool by clamping and unclamping a breakout wrench in conjunction with the deck wrench;

aligning used drilling tool flats with the deck wrench by forward rotating the drill pipe;

disengaging the deck wrench from the used drilling tool;

withdrawing the drill pipe and the used drilling tool to a retracted position;

pivotally rotating a drill tower from a drilling orientation to a change-out orientation;

moving a cassette access panel from a closed position to an open position;

extending the drill pipe and the used drilling tool to a change-out position above the drilling tool storage device;

pivotally raising the drilling tool storage device from a stowed position to a device change-out position;

de-coupling the used drilling tool from the drill pipe;

indexing the carriage such that a storage receptacle containing a replacement drilling tool is aligned with the drill pipe;

coupling the replacement drilling tool to the drill pipe;

lowering the drilling tool storage device from the change-out position to the stowed position;

withdrawing the drill pipe and the replacement drilling tool to the retracted position;

moving the cassette access panel from the open position to the closed position;

pivotally moving the drill tower from the change-out orientation to the drilling orientation;

extending the drill pipe and the replacement drilling tool to the breakout position;

engaging the deck wrench;

tightening the replacement drilling tool on the drill pipe by forward rotating the drill pipe up to a torque-up pressure;

aligning replacement drilling tool flats with the deck wrench; and retracting the deck wrench.

10. The method of claim 9, wherein engaging the deck wrench on the used drilling tool includes:

verifying that the deck wrench is fully extended by examining a sensor signal output from a linear transducer;

if the deck wrench is not fully extended, then:

disengaging the deck wrench;

forward rotating the drill pipe by approximately 10 degrees;

engaging the deck wrench; and verifying that the deck wrench is fully extended.

11. The method of claim 9, wherein positioning the drilling tool storage device and the carriage includes:

setting a target storage receptacle position to the empty storage receptacle;

verifying that the empty storage receptacle is aligned with the drill pipe; and if the empty storage receptacle is not aligned with the drill pipe, then:

verifying that the target storage receptacle position is greater than an aligned storage receptacle currently aligned with the drill pipe; and executing a controlled mechanical sequence until the empty storage receptacle is aligned with the drill pipe.

* * * * *